US011639536B2

(12) United States Patent
Hashimoto et al.

(10) Patent No.: US 11,639,536 B2
(45) Date of Patent: May 2, 2023

(54) STEEL SHEET FOR CARBURIZING, AND METHOD FOR MANUFACTURING STEEL SHEET FOR CARBURIZING

(71) Applicant: NIPPON STEEL CORPORATION, Tokyo (JP)

(72) Inventors: Motonori Hashimoto, Tokyo (JP); Kazuo Hikida, Tokyo (JP); Yuri Toda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 149 days.

(21) Appl. No.: 16/346,055

(22) PCT Filed: Aug. 30, 2018

(86) PCT No.: PCT/JP2018/032112
§ 371 (c)(1),
(2) Date: Apr. 29, 2019

(87) PCT Pub. No.: WO2019/044971
PCT Pub. Date: Mar. 7, 2019

(65) Prior Publication Data

US 2020/0181728 A1 Jun. 11, 2020

(30) Foreign Application Priority Data

Aug. 31, 2017 (JP) ..... JP2017-167206

(51) Int. Cl.

| | |
|---|---|
| ***C21D 9/46*** | (2006.01) |
| ***C21D 1/06*** | (2006.01) |
| ***C21D 1/76*** | (2006.01) |
| ***C21D 6/00*** | (2006.01) |
| ***C21D 8/02*** | (2006.01) |
| ***C22C 38/00*** | (2006.01) |
| ***C22C 38/02*** | (2006.01) |
| ***C22C 38/04*** | (2006.01) |

(Continued)

(52) U.S. Cl.

CPC ..... *C21D 9/46* (2013.01); *C21D 1/06* (2013.01); *C21D 1/76* (2013.01); *C21D 6/004* (2013.01); *C21D 6/005* (2013.01); *C21D 6/007* (2013.01); *C21D 6/008* (2013.01); *C21D 8/0205* (2013.01); *C21D 8/0226* (2013.01); *C21D 8/0236* (2013.01); *C21D 8/0263* (2013.01); *C22C 38/001* (2013.01); *C22C 38/002* (2013.01); *C22C 38/005* (2013.01); *C22C 38/008* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C23C 8/22* (2013.01); *C21D 2211/005* (2013.01)

(58) Field of Classification Search

CPC . C21D 9/46; C21D 1/06; C21D 6/005; C21D 1/76; C21D 6/004; C21D 6/007; C21D 6/008; C21D 8/0205; C21D 8/0226; C21D 8/0236; C21D 8/0263; C21D 2211/005; C22C 38/001; C22C 38/02; C22C 38/002; C22C 38/005; C22C 38/008; C22C 38/04; C22C 38/06; C22C 38/42; C22C 38/44; C22C 38/46; C22C 38/48; C22C 38/50; C22C 38/52; C22C 38/54; C22C 8/22

See application file for complete search history.

(56) References Cited

U.S. PATENT DOCUMENTS

2015/0047751 A1* 2/2015 Ono ..... C22C 38/60 148/504
2016/0265078 A1 9/2016 Kajihara et al.
(Continued)

FOREIGN PATENT DOCUMENTS

JP 3094856 B2 10/2000
JP JR 2013-18999 A 1/2013
(Continued)

OTHER PUBLICATIONS

Naro et al. ("Elimination and Neutralization of Boron in Ductile Irons", 2004) (Year: 2004).*
(Continued)

*Primary Examiner* — Robert S Jones, Jr.
*Assistant Examiner* — Jiangtian Xu
(74) *Attorney, Agent, or Firm* — Birch, Stewart, Kolasch & Birch, LLP

(57) ABSTRACT

[Object] To provide a steel sheet for carburizing that demonstrates improved ductility, and a method for manufacturing the same.

[Solution] A steel sheet consisting of, in mass %, C: more than or equal to 0.02%, and less than 0.30%, Si: more than or equal to 0.005%, and less than 0.5%, Mn: more than or equal to 0.01%, and less than 3.0%, P: less than or equal to 0.1%, S: less than or equal to 0.1%, sol. Al: more than or equal to 0.0002%, and less than or equal to 3.0%, N: less than or equal to 0.2%, Ti: more than or equal to 0.010%, and less than or equal to 0.150%, and the balance: Fe and impurities, in which the number of carbides per 1000 $\mu m^2$ is 100 or less, percentage of number of carbides with an aspect ratio of 2.0 or smaller is 10% or larger relative to the total carbides, average equivalent circle diameter of carbide is 5.0 μm or smaller, and average crystal grain size of ferrite is 10 μm or smaller.

3 Claims, No Drawings

(51) Int. Cl.

| | |
|---|---|
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C23C 8/22*** | (2006.01) |

(56) References Cited

U.S. PATENT DOCUMENTS

| | | | | |
|---|---|---|---|---|
| 2017/0067132 | A1* | 3/2017 | Takeda | C21D 8/0226 |
| 2018/0127848 | A1* | 5/2018 | Hikida | C22C 38/14 |
| 2018/0171445 | A1 | 6/2018 | Hikida et al. | |
| 2018/0230582 | A1 | 8/2018 | Takeda et al. | |

FOREIGN PATENT DOCUMENTS

| | | | | |
|---|---|---|---|---|
| JP | 2016-98384 | A | 5/2016 | |
| JP | 2016-169433 | A | 9/2016 | |
| JP | 6070912 | B1 | 2/2017 | |
| JP | 6119924 | B1 | 4/2017 | |
| JP | 6160783 | B2 | 7/2017 | |
| TW | 201213561 | A1 | 4/2012 | |
| WO | WO-2015133644 | A1 * | 9/2015 | C21D 9/46 |
| WO | WO 2016/148037 | A1 | 9/2016 | |
| WO | WO 2016/190370 | A1 | 12/2016 | |
| WO | WO 2016/190397 | A1 | 12/2016 | |
| WO | WO 2016/204286 | A1 | 12/2016 | |

OTHER PUBLICATIONS

International Preliminary Report on Patentability and English translation of the Written Opinion of the International Searching Authority for PCT/JP2018/032112 dated Mar. 12, 2020.

International Search Report for PCT/JP2018/032112 dated Nov. 27, 2018.

Search Report for TW 107130272 dated Jan. 25, 2019.

Written Opinion of the International Searching Authority for PCT/JP2018/032112 (PCT/ISA/237) dated Nov. 27, 2018.

Extended European Search Report for European Application No. 18852563.8, dated Feb. 6, 2020.

* cited by examiner

STEEL SHEET FOR CARBURIZING, AND METHOD FOR MANUFACTURING STEEL SHEET FOR CARBURIZING

TECHNICAL FIELD

The present invention relates to a steel sheet for carburizing, and a method for manufacturing the steel sheet for carburizing.

BACKGROUND ART

In recent years, mechanical and structural parts such as automotive gear, clutch plate and damper have been required to be highly durable, and in addition to be manufacturable at low costs. These parts have widely been manufactured by cutting and carburizing using hot-forged materials. However, in response to increasing need for cost reduction, having been developed are technologies by which hot-rolled steel sheet or cold-rolled steel sheet, employed as a starting material, is cold-worked into shapes of the parts, followed by carburizing.

The steel sheet, intended to be applied with these technologies, have been required to satisfy both of cold workability and hardenability after carburization heat treatment. It is widely accepted that, for improved hardenability, the larger the tensile strength of the steel sheet for carburizing, the better. The cold workability, however, degrades as the strength of steel sheet increases. Technologies for balancing these contradictory characteristics have been thus desired.

In the cold working, materials are punched, and then bent, drawn, or subjected to hole expansion or the like, to be formed into members. Formation into intricately shaped members, such as damper component for torque converter, is accomplished by combining a variety of deformation modes. Hence the cold workability may be improved by a method capable of improving stretch flangeability such as bendability and hole expandability, or a method capable of distinctively improving ductility of the steel sheet. From these points of view, a variety of technologies have been proposed in recent years.

For example, Patent Literature 1 listed below proposes a technology for forming a structure of a hot-rolled steel sheet with ferrite and pearlite, and then spherodizing carbide by spherodizing annealing.

Meanwhile, Patent Literature 2 listed below proposes a technology for improving impact characteristics of a carburized member, by controlling particle size of carbide, as well as controlling percentage of the number of carbides at ferrite crystal grain boundaries relative to the number of carbides within ferrite particles, and further by controlling crystal size of the ferrite matrix.

Moreover, Patent Literature 3 listed below proposes a technology for improving cold workability, by controlling particle size and aspect ratio of carbide, as well as controlling crystal size of ferrite matrix, and further by controlling aspect ratio of ferrite.

CITATION LIST

Patent Literature

Patent Literature 1: JP 3094856B
Patent Literature 2: WO 2016/190370
Patent Literature 3: WO 2016/148037

SUMMARY OF INVENTION

Technical Problem

The aforementioned mechanical and structural parts are required to be hardenable for enhanced strength. In other words, in order to enable cold forming of intricately shaped components, it is required to achieve formability, while keeping the hardenability.

The aforementioned microstructural control proposed in Patent Literature 1, mainly relying upon morphological control of carbide, can however yield only a steel sheet with poor ductility, which may hardly be processed into intricately-shaped members. Meanwhile, the manufacturing method proposed in Patent Literature 2, mainly relying upon microstructural control of carbide and ferrite, might improve formability of the obtainable steel sheet, but can hardly satisfy a required level of ductility suitable for process into intricately-shaped members. Moreover, the method proposed in Patent Literature 3 might improve formability of the obtainable steel sheet, but again, can hardly satisfy a required level of ductility suitable for process into intricately-shaped members. As described above, it has been difficult for the technologies having ever been proposed to enhance the ductility of the steel sheet for carburizing, and this has restricted the highly hardenable steel sheet to be applied to intricately shaped components, particularly to damper component of torque converter.

The present invention was made in consideration of the aforementioned problems, and an object of the present invention is to provide a steel sheet for carburizing that demonstrates improved ductility, and a method for manufacturing the same.

Solution to Problem

The present inventors extensively examined methods for solving the aforementioned problems, and consequently reached an idea that a steel sheet for carburizing with improved ductility is obtainable, while sustaining the hardenability, by reducing the number density of carbides produced in the steel sheet, and by micronizing ferrite crystal grains in the steel sheet as will be detailed later, and reached the present invention.

Summary of the present invention reached on the basis of such idea is as follows.

[1]

A steel sheet for carburizing consisting of, in mass %,
C: more than or equal to 0.02%, and less than 0.30%,
Si: more than or equal to 0.005%, and less than 0.5%,
Mn: more than or equal to 0.01%, and less than 3.0%,
P: less than or equal to 0.1%,
S: less than or equal to 0.1%,
sol. Al: more than or equal to 0.0002%, and less than or equal to 3.0%,
N: less than or equal to 0.2%,
Ti: more than or equal to 0.010%, and less than or equal to 0.150%, and the balance: Fe and impurities, in which the number of carbides per 1000 $\mu m^2$ is 100 or less, percentage of number of carbides with an aspect ratio of 2.0 or smaller is 10% or larger relative to the total carbides, average equivalent circle diameter of carbide is 5.0 μm or smaller, and average crystal grain size of ferrite is 10 μm or smaller.

[2]

The steel sheet for carburizing according to [1], further including, in place of part of the balance Fe, one of, or two or more of, in mass %, Cr: more than or equal to 0.005%, and less than or equal to 3.0%

Mo: more than or equal to 0.005%, and less than or equal to 1.0%,

Ni: more than or equal to 0.010%, and less than or equal to 3.0%,

Cu: more than or equal to 0.001%, and less than or equal to 2.0%,

Co: more than or equal to 0.001%, and less than or equal to 2.0%,

Nb: more than or equal to 0.010%, and less than or equal to 0.150%,

V: more than or equal to 0.0005%, and less than or equal to 1.0%, and

B: more than or equal to 0.0005%, and less than or equal to 0.01%.

[3]

The steel sheet for carburizing according to [1] or [2], further including, in place of part of the balance Fe, one of, or two or more of, in mass %, Sn: less than or equal to 1.0%, W: less than or equal to 1.0%, Ca: less than or equal to 0.01%, and REM: less than or equal to 0.3%.

[4]

A method for manufacturing the steel sheet for carburizing according to any one of [1] to [3], the method including:

a hot-rolling step, in which a steel material having the chemical composition according to any one of [1] to [3] is heated, hot finish rolling is terminated in a temperature range of 800° C. or higher and lower than 920° C., followed by cooling over a temperature range from a temperature at an end point of hot finish rolling down to a cooling stop temperature at an average cooling rate of 50° C./s or higher and 250° C./s or lower, and by winding at a temperature of 700° C. or lower; and a first annealing step, in which a steel sheet obtained by the hot-rolling step, or, a steel sheet having been cold-rolled subsequently to the hot-rolling step is heated in an annealing atmosphere with nitrogen concentration controlled to lower than 25% in volume fraction, at an average heating rate of 1° C./h or higher and 100° C./h or lower, up into a temperature range not higher than point $Ac_1$ defined by equation (1) below, and retained in the temperature range not higher than point $Ac_1$ for 1 h or longer and 100 h or shorter;

a second annealing step, in which the steel sheet after undergone the first annealing step is heated at the average heating rate of 1° C./h or higher and 100° C./h or lower, up into a temperature range from exceeding point $Ac_1$ defined by equation (1) below to 790° C. or lower, and retained in the temperature range from exceeding point $Ac_1$ to 790° C. or lower for 1 h or longer and 100 h or shorter; and a cooling step of cooling the steel sheet after annealed in the second annealing step, at an average cooling rate of 1° C./h or higher and 100° C./h or lower in a temperature range from a temperature at an end point of annealing in the second annealing step down to 550° C.

[5]

The method for manufacturing the steel sheet for carburizing according to [4], further including, between the hot-rolling step and the first annealing step:

retaining the steel sheet obtained from the hot-rolling step, in an atmosphere air, at a temperature from 40° C. or higher and 70° C. or lower, for 72 h or longer and 350 h or shorter.

[Math. 1]

$$Ac_1=750.8-26.6[C]+17.6[Si]-11.6[Mn]-22.9[Cu]-23[Ni]+24.1[Cr]+22.5[Mo]-39.7[V]-5.7[Ti]+232.4[Nb]-169.4[Al]-894.7[B] \quad \text{Equation (1)}$$

In equation (1) above, notation [X] represents the content of element X (in mass %), which is substituted by zero if such element X is absent.

Advantageous Effects of Invention

As explained above, according to the present invention, it now becomes possible to provide a steel sheet for carburizing that further excels in hardenability, formability and ductility.

DESCRIPTION OF EMBODIMENTS

Preferred embodiments of the present invention will be detailed below.

(Details of Examination Made by Present Inventors, and Reached Idea)

Prior to description on the steel sheet for carburizing and the method for manufacturing the same according to the present invention, the examination made by the present inventors, aimed at solving the aforementioned problems, will be detailed below.

In the examination, the present inventors examined a method for improving the ductility.

Ductility is a characteristic that involves uniform elongation and local elongation. A variety of technologies for primarily improving uniform elongation, among from the aforementioned two viewpoints regarding ductility, have been proposed. In order to form intricately-shaped components, it is however important to improve not only uniform elongation, but also local elongation at the same time. Approaches to microstructural control for the improvement are different between uniform elongation and local elongation. The present inventors then made extensive investigations into methods for structural control capable of concomitantly improving these two types of elongation, and consequently reached an idea that reduction in the number density of carbide, as well as micronization of ferrite crystal grain as a result of incorporation of Ti, are effective to improve both of uniform elongation and local elongation.

The previous approaches to improve the uniform elongation aiming at improving the workability, including technologies proposed in aforementioned Patent Literatures 1 to 3, have not intentionally employed Ti to be incorporated, having a large potential of grain micronization, since the larger the ferrite grains, the better. The present invention is featured by two-stage annealing employed in the process of manufacturing the steel sheet for carburizing according to this invention, as explained later. Referring now to the prior case where a predetermined amount of Ti was not contained as a steel sheet component, the grains would be increasingly coarsened through the two-stage annealing, so that the local elongation, out of the ductilities, has been inevitably degraded. The present inventors, however, successfully reached findings regarding a method of structural control capable of improving both of uniform elongation and local elongation, after our extensive investigations. The findings will be detailed below.

First, in order to improve the uniform elongation, it is effective to suppress generation of voids during tensile deformation. In the tensile deformation, the voids tend to generate at an interface between a hard structure and a soft structure. In the steel sheet for carburizing, generation of voids is promoted at the interface between ferrite and carbide. Hence, the present inventors reached an idea that the voids could be suppressed from generating by reducing the number density of carbide that resides in the steel sheet, to thereby reduce the total area of interface between ferrite and carbide.

After thorough examination based on this idea, the present inventors could reduce the number density of carbide, by employing two-stage heating conditions for the spherodizing annealing. More specifically, the present inventors succeeded in reducing the number density of carbide in such a way that, in a spherodizing annealing step, a steel sheet after undergone a hot-rolling step is subjected to a first stage annealing in which the steel sheet is heated up into a temperature range not higher than point $Ac_1$, and retained in the temperature range not higher than point $Ac_1$ for 1 h or longer and 100 h or shorter; and the steel sheet after undergone the first stage annealing is then subjected to a second stage annealing in which the steel sheet is heated up into a temperature range from exceeding point $Ac_1$ to 790° C. or lower, and retained in the temperature range from exceeding point $Ac_1$ to 790° C. or lower for 1 h or longer and 100 h or shorter.

A possible mechanism is as follows. First, retention under heating in the first stage is carried out at a temperature not higher than point $Ac_1$, so as to promote diffusion of carbon to thereby spherodize plate-like carbide having been produced in the hot-rolling step. In this first stage, the steel sheet structure is mainly composed of ferrite and carbide, and contains fine carbide and coarse carbide in a mixed manner. Next, retention under heating in the second stage is carried out at a temperature exceeding point $Ac_1$, so as to melt the fine carbide to thereby reduce the number density of carbide. Since Ostwald ripening of the carbide occurs in this temperature range from exceeding point $Ac_1$, the fine carbide is considered to melt increasingly, and thereby the number density of carbide can be reduced.

Next, in order to improve the local elongation, the key is to suppress voids from fusing. In order to suppress fusion of voids, it is effective to micronize matrix ferrite grains. The present inventors have arrived at an idea that, if the grain boundary increases as a result of micronization, the voids having been generated at the interface between carbide and ferrite would be less likely to fuse. After thorough investigations based on such idea, the present inventors found that an effect of suppressing fusion of voids is obtainable by controlling the average crystal grain size of ferrite to 10 μm or smaller.

The present inventors then further examined into a manufacturing method for micronizing ferrite, and found that austenite before transformation may be micronized by subjecting a steel sheet with a Ti content of 0.010% or more to hot-rolling; and additionally found that phase transition towards ferrite may be triggered, while suppressing austenitic grain from growing, by cooling and winding up the steel sheet immediately after the hot finish rolling at an average cooling rate of 50° C./s or higher. In this way, sites of nucleation of ferrite will increase, making it possible to micronize the ferrite grains.

By way of the aforementioned microstructural control from the two points of view, both of the uniform elongation and local elongation were improved together, and thereby the steel sheet for carburizing having more advanced ductility, while sustaining the hardenability, was successfully obtained. As a result of such advanced ductility, the steel sheet for carburizing can demonstrate more advanced formability.

Note that regarding the aforementioned improvement in ductility (uniform elongation and local elongation), the larger the hardenability of steel sheet, the larger the effect of improvement. For example, the ductility distinctively improves in high strength steel sheet with a tensile strength of 340 MPa or larger, such as those in 340 MPa class and 440 MPa class. Hence it will become possible to improve the ductility while sustaining the hardenability, as a result of the structural control outlined above. With such advanced ductility, the steel sheet for carburizing can demonstrate more advanced formability as a consequence.

The steel sheet for carburizing and the method for manufacturing the same according to embodiments of the present invention, as detailed later, have been reached on the basis of the aforementioned findings. Paragraphs below will detail the steel sheet for carburizing and the method for manufacturing the same according to the embodiments reached on the basis of the findings.

(Steel Sheet for Carburizing)

First, the steel sheet for carburizing according to the embodiment of the present invention will be detailed.

The steel sheet for carburizing according to the embodiment has a predetermined chemical composition detailed below. In addition, the steel sheet for carburizing according to this embodiment has a specific microstructure in which the number of carbides per 1000 $\mu m^2$ is 100 or less; the percentage of the number of carbides with an aspect ratio of 2.0 or smaller is 10% or larger relative to the total carbides; the average equivalent circle diameter of carbide is 5.0 μm or smaller; and the average crystal grain size of ferrite is 10 μm or smaller. With such features, the steel sheet for carburizing according to this embodiment will have more advanced ductility and formability, while sustaining the hardenability.

<Chemical Composition of Steel Sheet for Carburizing>

First, chemical components contained in the steel sheet for carburizing according to the embodiment will be detailed below. Note that in the following description, notation "%" relevant to the chemical components means "mass %", unless otherwise specifically noted.

[C: More than or Equal to 0.02%, and Less than 0.30%]

C (carbon) is an element necessary for keeping strength at the center of thickness of a finally obtainable carburized member. In the steel sheet for carburizing, C is also an element solid-soluted into the grain boundary of ferrite to enhance the strength of the grain boundary, to thereby contribute to improvement of the local elongation.

With the content of C less than 0.02%, the aforementioned effect of improving the local elongation will not be obtained. Hence the content of C in the steel sheet for carburizing according to the embodiment is specified to be more than or equal to 0.02%. The content of C is preferably more than or equal to 0.05%. Meanwhile, with the content of C more than or equal to 0.30%, carbide produced in the steel sheet for carburizing will have an average equivalent circle diameter exceeding 5.0 μm, thereby the uniform elongation will degrade. Hence the content of C in the steel sheet for carburizing according to the embodiment is specified to be less than 0.30%. The content of C is preferably less than or equal to 0.20%. In addition, considering the individual balances among the uniform elongation and local elongation, as well as hardenability, the content of C is preferably less than or equal to 0.10%, and more preferably less than 0.10%.

[Si: More than or Equal to 0.005%, and Less than 0.5%]

Si (silicon) is an element that acts to deoxidize molten steel to improve soundness of the steel. With the content of Si less than 0.005%, the molten steel will not thoroughly be deoxidized. Hence the content of silicon in the steel sheet for carburizing according to the embodiment is specified to be more than or equal to 0.005%. The content of Si is preferably more than or equal to 0.01%. Meanwhile, with the content of S more than or equal to 0.5%, Si that is solid-soluted in carbide stabilizes the carbide, and inhibits melting of the carbide in the first stage of annealing, so that the number density of carbide will not be reduced, thus degrading the uniform elongation. Hence the content of Si in the steel sheet for carburizing according to the embodiment is specified to be less than 0.5%. The content of Si is preferably less than 0.3%, and more preferably less than 0.1%.

[Mn: More than or Equal to 0.01%, and Less than 3.0%]

Mn (manganese) is an element that acts to deoxidize molten steel to improve soundness of the steel. With the content of Mn less than 0.01%, the molten steel will not thoroughly be deoxidized. Hence the content of Mn in the steel sheet for carburizing according to the embodiment is specified to be more than or equal to 0.01%. The content of Mn is preferably more than or equal to 0.1%. Meanwhile, with the content of Mn more than or equal to 3.0%, Mn that is solid-soluted in carbide stabilizes the carbide, and inhibits melting of the carbide in the first stage of annealing, so that the number density of carbide will not be reduced, thus degrading the uniform elongation. Hence, the content of Mn in the steel sheet for carburizing according to this embodiment is specified to be less than 3.0%. The content of Mn is more preferably less than 2.0%, and even more preferably less than 1.0%.

[P: Less than or Equal to 0.1%]

P (phosphorus) is an element that segregates in the grain boundary of ferrite and promotes brittle fracture to degrade the ductility. With the content of P exceeding 0.1%, the grain boundary of ferrite will have considerably reduced strength, and thereby the uniform elongation will degrade. Hence, the content of P in the steel sheet for carburizing according to the embodiment is specified to be less than or equal to 0.1%. The content of P is preferably less than or equal to 0.050%, and more preferably less than or equal to 0.020%. Note that the lower limit of the content of P is not specifically limited. The content of P reduced below 0.0001% will however considerably increase cost for dephosphorization, causing economic disadvantage. Hence the lower limit of content of P will substantially be 0.0001% for practical steel sheet.

[S: Less than or Equal to 0.1%]

S (sulfur) is an element that can form an inclusion to degrade the ductility. With the content of S exceeding 0.1%, a coarse inclusion will be produced, and thereby the uniform elongation will degrade. Hence the content of S in the steel sheet for carburizing according to the embodiment is specified to be less than or equal to 0.1%. The content of S is preferably less than or equal to 0.010%, and more preferably less than or equal to 0.008%. Note that the lower limit of content of S is not specifically limited. The content of S reduced below 0.0005% will however considerably increase cost for desulfurization, causing economic disadvantage. Hence, the lower limit of content of S will substantially be 0.0005% for practical steel sheet.

[Sol. Al: More than or Equal to 0.0002%, and Less than or Equal to 3.0%]

Al (aluminum) is an element that acts to deoxidize molten steel to improve soundness of the steel. With the content of Al less than 0.0002%, the molten steel will not thoroughly be deoxidized. Hence the content of Al (in more detail, the content of sol. Al) in the steel sheet for carburizing according to the embodiment is specified to be more than or equal to 0.0002%. The content of Al is preferably more than or equal to 0.0010%. Meanwhile, with the content of Al exceeding 3.0%, coarse oxide will be produced, and thereby the uniform elongation will degrade. Hence the content of Al is specified to be less than or equal to 3.0%. The content of Al is preferably less than or equal to 2.5%, more preferably less than or equal to 1.0%, even more preferably less than or equal to 0.5%, and yet more preferably less than or equal to 0.1%.

[N: Less than or Equal to 0.2%]

In the steel sheet for carburizing according to this embodiment, the content of N (nitrogen) need be less than or equal to 0.2%. With the content of N exceeding 0.2%, coarse nitride will be produced, and thereby the local elongation will be degraded considerably. Hence, the content of N in the steel sheet for carburizing according to the embodiment is specified to be less than or equal to 0.2%. The content of N is preferably less than or equal to 0.1%, more preferably less than or equal to 0.05%, and even more preferably less than or equal to 0.01%. The lower limit of content of N is not specifically limited. The content of N reduced below 0.0001% will however considerably increase cost for denitrification, causing economic disadvantage. Hence, the lower limit of content of N will substantially be 0.0001% for practical steel sheet.

[Ti: More than or Equal to 0.010%, and Less than or Equal to 0.150%]

Ti (titanium) is an element that contributes to micronize ferrite through micronization of prior austenite in the hot-rolling step, and contributes to improve the local elongation. In order to obtain an effect of thus micronizing ferrite, the content of Ti in the steel sheet for carburizing according to this embodiment is specified to be more than or equal to 0.010%. The content of Ti is preferably more than or equal to 0.015%. Meanwhile, considering an effect of production of carbide and nitride, the content of Ti is specified to be less than or equal to 0.150%, in view of achieving an effect of improving the local elongation. The content of Ti is preferably less than or equal to 0.075%.

[Cr: More than or Equal to 0.005%, and Less than or Equal to 3.0%]

Cr (chromium) is an element having an effect of increasing the hardenability of the finally obtainable carburized member, and is also an element, for the steel sheet for carburizing, having an effect of micronizing ferrite crystal grains to further improve the local elongation. Hence in the steel sheet for carburizing according to the embodiment, Cr may be contained as needed. In order to obtain more enhanced effect of local elongation, the content of Cr, if contained, is preferably specified to be more than or equal to 0.005%. The content of Cr is more preferably more than or equal to 0.010%. Further, in consideration of the effects of production of carbide and nitride, the content of Cr is preferably less than or equal to 3.0%, in view of obtaining more enhanced effect of local elongation. The content of Cr is more preferably less than or equal to 2.0%, and even more preferably less than or equal to 1.5%.

[Mo: More than or Equal to 0.005%, and Less than or Equal to 1.0%]

Mo (molybdenum) is an element having an effect of increasing the hardenability of the finally obtainable carburized member, and is also an element, for the steel sheet for carburizing, having an effect of micronizing ferrite crystal grains to further improve the local elongation. Hence in the steel sheet for carburizing according to the embodiment, Mo may be contained as needed. In order to obtain more enhanced effect of local elongation, the content of Mo, if contained, is preferably specified to be more than or equal to 0.005%. The content of Mo is more preferably more than or equal to 0.010%. Further, in consideration of the effects of production of carbide and nitride, the content of Mo is preferably less than or equal to 1.0%, in view of obtaining more enhanced effect of local elongation. The content of Mo is more preferably less than or equal to 0.8%.

[Ni: More than or Equal to 0.010%, and Less than or Equal to 3.0%]

Ni (nickel) is an element having an effect of increasing the hardenability of the finally obtainable carburized member, and is also an element, for the steel sheet for carburizing, having an effect of micronizing ferrite crystal grains to further improve the local elongation. Hence in the steel sheet for carburizing according to the embodiment, Ni may be contained as needed. In order to obtain more enhanced effect of local elongation, the content of Ni, if contained, is preferably specified to be more than or equal to 0.010%. The content of Ni is more preferably more than or equal to 0.050%. Further, in consideration of the effects of segregation of Ni in the grain boundary, the content of Ni is preferably less than or equal to 3.0%, in view of obtaining more enhanced effect of local elongation. The content of Ni is more preferably less than or equal to 2.0%, even more preferably less than or equal to 1.0%, and yet more preferably less than or equal to 0.5%.

[Cu: More than or Equal to 0.001%, and Less than or Equal to 2.0%]

Cu (copper) is an element having an effect of increasing the hardenability of the finally obtainable carburized member, and is also an element, for the steel sheet for carburizing, having an effect of micronizing ferrite crystal grains to further improve the local elongation. Hence in the steel sheet for carburizing according to the embodiment, Cu may be contained as needed. In order to obtain more enhanced effect of local elongation, the content of Cu, if contained, is preferably specified to be more than or equal to 0.001%. The content of Cu is more preferably more than or equal to 0.010%. Further, in consideration of the effects of segregation of Cu in the grain boundary, the content of Cu is preferably less than or equal to 2.0%, in view of obtaining more enhanced effect of local elongation. The content of Cu is more preferably less than or equal to 0.80%, and even more preferably less than or equal to 0.50%.

[Co: More than or Equal to 0.001%, and Less than or Equal to 2.0%]

Co (cobalt) is an element having an effect of increasing the hardenability of the finally obtainable carburized member, and is also an element, for the steel sheet for carburizing, having an effect of micronizing ferrite crystal grains to further improve the local elongation. Hence in the steel sheet for carburizing according to the embodiment, Co may be contained as needed. In order to obtain more enhanced effect of local elongation, the content of Co, if contained, is preferably specified to be more than or equal to 0.001%. The content of Co is more preferably more than or equal to 0.010%. Further, in consideration of the effects of segregation of Co in the grain boundary, the content of Co is preferably less than or equal to 2.0%, in view of obtaining more enhanced effect of local elongation. The content of Co is more preferably less than or equal to 0.80%.

[Nb: More than or Equal to 0.010%, and Less than or Equal to 0.150%]

Nb (niobium) is an element that contributes to micronize crystal grains to further improve the local elongation. Hence in the steel sheet for carburizing according to the embodiment, Nb may be contained as needed. In order to obtain more enhanced effect of local elongation, the content of Nb, if contained, is preferably specified to be more than or equal to 0.010%. The content of Nb is more preferably more than or equal to 0.035% Further, in consideration of the effects of production of carbide and nitride, the content of Nb is preferably less than or equal to 0.150%, in view of obtaining more enhanced effect of local elongation. The content of Nb is more preferably less than or equal to 0.120%, and even more preferably less than or equal to 0.100%.

[V: More than or Equal to 0.0005%, and Less than or Equal to 1.0%]

V (vanadium) is an element that contributes to micronize ferrite crystal grains to further improve the local elongation. Hence in the steel sheet for carburizing according to the embodiment, V may be contained as needed. In order to obtain more enhanced effect of local elongation, the content of V, if contained, is preferably specified to be more than or equal to 0.0005%. The content of V is more preferably more than or equal to 0.0010% Further, in consideration of the effects of production of carbide and nitride, the content of V is preferably less than or equal to 1.0%, in view of obtaining more enhanced effect of local elongation. The content of V is more preferably less than or equal to 0.80%, even more preferably less than or equal to 0.10%, and yet more preferably less than or equal to 0.050%.

[B: More than or Equal to 0.0005%, and Less than or Equal to 0.01%]

B (boron) is an element that segregates in the grain boundary of ferrite to enhance strength of the grain boundary, to thereby further improve the uniform elongation. Hence in the steel sheet for carburizing according to the embodiment, B may be contained as needed. In order to obtain more enhanced effect of uniform elongation, the content of B, if contained, is preferably specified to be more than or equal to 0.0005%. The content of B is more preferably more than or equal to 0.0010% Note that, such more enhanced effect of uniform elongation will saturate if the content of B exceeds 0.01%, so that the content of B is preferably specified to be less than or equal to 0.01%. The content of B is more preferably less than or equal to 0.0075%, even more preferably less than or equal to 0.0050%, and yet more preferably less than or equal to 0.0030%.

[Sn: Less than or Equal to 1.0%]

Sn (tin) is an element that acts to deoxidize molten steel to improve soundness of the steel. Hence in the steel sheet for carburizing according to the embodiment, Sn may be contained as needed at a maximum content of 1.0%. The content of Sn is more preferably less than or equal to 0.5%.

[W: Less than or Equal to 1.0%]

W (tungsten) is an element that acts to deoxidize molten steel to improve soundness of the steel. Hence in the steel sheet for carburizing according to the embodiment, W may be contained as needed at a maximum content of 1.0%. The content of W is more preferably less than or equal to 0.5%.

[Ca: Less than or Equal to 0.01%]

Ca (calcium) is an element that acts to deoxidize molten steel to improve soundness of the steel. Hence in the steel sheet for carburizing according to the embodiment, Ca may be contained as needed at a maximum content of 0.01%. The content of Ca is more preferably less than or equal to 0.005%.

[REM: Less than or Equal to 0.3%]

REM (rare metal) is element(s) that act(s) to deoxidize molten steel to improve soundness of the steel. Hence in the steel sheet for carburizing according to the embodiment, REM may be contained as needed at a maximum content of 0.3%.

Note that REM is a collective name for 17 elements in total including Sc (scandium), Y (yttrium) and the lanthanide series elements, and the content of REM means the total amount of these elements. Although misch metal is often used to introduce REM, in some cases also the lanthanide series elements besides La (lanthanum) and Ce (cerium) may be introduced in a combined manner. Also in this case, the steel sheet for carburizing according to this embodiment demonstrates an effect that the steel sheet excels not only in hardenability and formability, but also in ductility. In addition, the steel sheet for carburizing according to the embodiment will exhibit excellent ductility, even if metallic REM such as metallic La and Ce are contained.

[Balance: Fe and Impurities]

The balance of the component composition at the center of thickness includes Fe and impurities. The impurities are exemplified by elements derived from the starting steel or scrap, and/or inevitably incorporated in the process of steel making, which are acceptable so long as characteristics of the steel sheet for carburizing according to the embodiment will not be adversely affected.

Chemical components contained in the steel sheet for carburizing according to the embodiment have been detailed.

<Microstructure of Steel Sheet for Carburizing>

Next, the microstructure that makes up the steel sheet for carburizing according to the embodiment will be detailed.

The microstructure of the steel sheet for carburizing according to the embodiment is substantially composed of ferrite and carbide. In more detail, the microstructure of the steel sheet for carburizing according to the embodiment is composed so that the percentage of area of ferrite typically falls in the range from 85 to 95%, the percentage of area of carbide typically falls in the range from 5 to 15%, and the total percentage of area of ferrite and carbide will not exceed 100%.

Such percentages of area of ferrite and carbide are measured by using a sample sampled from the steel sheet for carburizing so as to produce the cross section to be observed in the direction perpendicular to the width direction. A length of sample of 10 mm to 25 mm or around will suffice, although depending on types of measuring instrument. The surface to be observed of the sample is polished, and then etched using nital. The surface to be observed, after etched with nital, is observed in regions at a quarter thickness position (which means a position in the thickness direction of the steel sheet for carburizing, quarter thickness away from the surface), at a ⅜ thickness position, and at the half thickness position, under a thermal-field-emission type scanning electron microscope (for example, JSM-7001F from JEOL, Ltd.).

Each sample is observed for the regions having an area of 2500 $\mu m^2$ in ten fields of view, and percentages of areas occupied by ferrite and carbide relative to the area of field of view are measured for each field of view. An average value of percentages of area occupied by ferrite, being averaged from all fields of view, and, an average value of percentages of area occupied by carbide, being averaged from all fields of view, are respectively denoted as the percentage of area of ferrite, and, the percentage of area of carbide.

Now the carbide in the microstructure according to the embodiment is mainly iron carbide such as cementite which is a compound of iron and carbon ($Fe_3C$), and, s carbide ($Fe_{2-3}C$). Alternatively, besides the aforementioned iron carbide, the carbide in the microstructure occasionally contains a compound derived from cementite having Fe atoms substituted by Mn, Cr and so forth, and alloy carbides (such as $M_{23}C_6$, $M_6C$ and MC, where M represents Fe and other metal element, or, metal element other than Fe). Most part of the carbide in the microstructure according to the embodiment is composed of iron carbide. Hence, focusing now on the later-detailed number of such carbides, the number may be the total number of the aforementioned various carbides, or may be the number of iron carbide only. That is, the later-described percentage of the number of carbides may be defined on the basis of a population that contains various carbides including iron carbide, or may be defined on the basis of a population that contains iron carbide only. The iron carbide may be identified typically by subjecting the sample to diffractometry or EDS (Energy Dispersive X-ray spectrometry).

As explained previously, in order to improve the ductility of the steel sheet for carburizing, it is important to reduce the number density of carbide, and in addition to micronize the ferrite crystal grains by incorporating Ti.

The ductility involves uniform elongation and local elongation as described previously. A variety of technologies for primarily improving uniform elongation, among from these two viewpoints regarding ductility, have been proposed. In order to form intricately-shaped components, it is however important to improve not only uniform elongation, but also local elongation at the same time. Approaches to microstructural control for the improvement are different between uniform elongation and local elongation. The present inventors then made extensive investigations into methods for structural control capable of concomitantly improving these two types of elongation, and consequently arrived at findings below.

First, in order to improve the uniform elongation, it is effective to suppress generation of voids during tensile deformation. In the tensile deformation, the voids tend to generate at an interface between a hard structure and a soft structure. In the steel sheet for carburizing, generation of voids is promoted at the interface between ferrite and carbide. Then after thorough investigations, the present inventors reached an idea that the voids could be suppressed from generating by reducing the number density of carbide, to thereby reduce the total area of interface between ferrite and carbide.

Next, in order to improve the local elongation, the key is to suppress voids from fusing. In order to suppress fusion of voids, it is effective to micronize matrix ferrite grains. The present inventors have arrived at an idea that, if the grain boundary increases as a result of micronization, the voids having been generated at the interface between carbide and ferrite would be less likely to fuse. After thorough investigations based on such idea, the present inventors found that the voids can be suppressed from fusing by controlling the average crystal grain size of ferrite to 10 μm or smaller.

Reasons for limiting the microstructure that makes up the steel sheet for carburizing according to the embodiment will be detailed below.

[Number of Carbides Per 1000 $\mu m^2$: 100 or Less]

As mentioned previously, the carbide in this embodiment is mainly composed of iron carbide such as cementite ($Fe_3C$) and c carbide ($Fe_{2-3}C$). Investigations by the present inventors revealed that good uniform elongation is obtainable if the number of carbides per 1000 $\mu m^2$ is controlled to 100 or less. Hence in the steel sheet for carburizing according to this embodiment, the number of carbides per 1000 $\mu m^2$ is specified to be 100 or less. Now, as is clear from a measurement method described later, "the number of carbides per 1000 $\mu m^2$" in this embodiment is an average number of carbides in a freely selectable region having an area of 1000 $\mu m^2$, at an quarter thickness position of the steel sheet for carburizing. The number of carbides per 1000 $\mu m^2$ is preferably 90 or less. Note that the lower limit of the number of carbides per 1000 $\mu m^2$ is not specifically limited. Since, however, it is difficult to control the number of carbides per 1000 $\mu m^2$ to less than 5 in practical operation, 5 will be a substantial lower limit.

[Percentage of Number of Carbides with Aspect Ratio of 2.0 or Smaller, Relative to Total Carbides: 10% or Larger]

Investigation by the present inventors revealed that good uniform elongation is obtainable, if the percentage of the number of carbides with an aspect ratio of 2.0 or smaller, relative to the total carbides, is 10% or larger. With the percentage of the number of carbides with an aspect ratio of 2.0 or smaller relative to the total carbides fallen below 10%, good uniform elongation will not be obtained due to accelerated cracking during tensile deformation. Therefore in the steel sheet for carburizing according to the embodiment, the percentage of the number of carbides with an aspect ratio of 2.0 or smaller, relative to the total carbides, is specified to be 10% or larger. The percentage of the number of carbides with an aspect ratio of 2.0 or smaller relative to the total carbides is more preferably 20% or larger, for further improvement of the uniform elongation. Note that there is no special limitation on the upper limit of the percentage of the number of carbides with an aspect ratio of 2.0 or smaller relative to the total carbides. Since, however, it is difficult to achieve 98% or larger in practical operation, 98% will be a substantial upper limit.

[Average Equivalent Circle Diameter of Carbide: 5.0 μm or Smaller]

In the microstructure of the steel sheet for carburizing according to the embodiment, the average equivalent circle diameter of carbide need be 5.0 μm or smaller. With the average equivalent circle diameter of carbide exceeding 5.0 μm, good uniform elongation will not be obtained due to cracking that occurs during tensile deformation. The smaller the average equivalent circle diameter of carbide is, the better the uniform elongation is. The average equivalent circle diameter is preferably 1.0 μm or smaller. The lower limit value of the average equivalent circle diameter of carbide is not specifically limited. Since, however, it is difficult to achieve an average equivalent circle diameter of carbide of 0.01 μm or smaller in practical operation, 0.01 μm will be a substantial lower limit.

[Average Crystal Grain Size of Ferrite: 10 μm or Smaller]

In the microstructure of the steel sheet for carburizing according to this embodiment, the average crystal grain size of ferrite need be 10 μm or smaller. With the average crystal grain size of ferrite exceeding 10 μm, cracks will be increasingly allowed to extend during tensile deformation, making it unable to obtain good local elongation. The smaller the average crystal grain size of ferrite, the better the local elongation. The average crystal grain size of ferrite is preferably 8.0 μm or smaller. The lower limit of the average crystal grain size of ferrite is not specifically limited. Since, however, it is difficult to control the average crystal grain size of ferrite to 0.1 μm or smaller in practical operation, 0.1 μm will be a substantial lower limit.

Next, methods for measuring the number and the percentage of the number of carbides, the average equivalent circle diameter of carbide, as well as the average crystal grain size of ferrite in the microstructure will be detailed below.

First, a sample is cut out from the steel sheet for carburizing, so as to produce a cross section to be observed, which is perpendicular to the surface (thickness-wise cross section). A length of sample of 10 mm or around will suffice, although depending on types of measuring instrument. The cross section is polished and corroded, and is then subjected to measurement of the number density, aspect ratio, and the average equivalent circle diameter of carbide, and, the average crystal grain size of ferrite. For the polishing, it suffices for example to polish the surface to be measured using a 600-grit to 1500-grit silicon carbide sandpaper, and then to specularly finish the surface using a liquid having diamond powder of 1 μm to 6 μm in diameter dispersed in a diluent such as alcohol or in water. The corrosion is not specifically limited so long as the interface between carbide and ferrite, or, ferrite grain boundary may be predominantly corroded. For example, employable is etching using a 3% nitric acid solution in alcohol, or a means for corroding grain boundary between carbide and base iron, such as potentiostatic electrolytic etching using a nonaqueous solvent-based electrolyte (Fumio Kurosawa et al., Journal of the Japan Institute of Metals and Materials (in Japanese), 43, 1068, (1979)), by which the base iron is removed to a depth of several micrometers so as to allow the carbide only to remain.

The number density of carbide is estimated by photographing a 2500 $\mu m^2$ area at around a quarter thickness position of the sample, which is 20 μm deep in the thickness direction and 50 μm long in the rolling direction, under a thermal-field-emission type scanning electron microscope (for example, JSM-7001F from JEOL, Ltd.), and the number of carbides in the photographed field of view is measured using image analysis software (for example, IMage-Pro Plus from Media Cybernetics, Inc.). Five fields of views are measured in the same way, and an average value from the five fields of view is specified as the number of carbides per 1000 $\mu m^2$.

The aspect ratio of carbide is estimated by observing a 2500 $\mu m^2$ area at around a quarter thickness position of the sample, under a thermal-field-emission type scanning electron microscope (for example, JSM-7001F from JEOL, Ltd.). All carbides contained in an observed field of view are measured regarding the long axes and the short axes to calculate aspect ratios (long axis/short axis), and an average value of the aspect ratios is determined. Such observation is made in five fields of view, and an average value for these five fields of view is determined as the aspect ratio of carbide in the sample. Referring to the thus obtained aspect ratio of carbide, the percentage of the number of carbides with an aspect ratio of 2.0 or smaller relative to the total carbides is calculated, on the basis of the total number of carbides with an aspect ratio of 2.0 or smaller, and the total number of carbides present in the five fields of view.

The average equivalent circle diameter of carbide is estimated by observing a 600 $\mu m^2$ area at around a quarter thickness position of the sample in four fields of view, under a thermal-field-emission type scanning electron microscope (for example, JSM-7001F from JEOL, Ltd.). For each field of view, the long axes and the short axes of captured carbides are individually measured, using image analysis software (for example, IMage-Pro Plus from Media Cybernetics, Inc.). For each carbide in the field of view, the long axis and the short axis are averaged to obtain the diameter of carbide, and the diameters obtained from all carbides captured in the field of view are averaged. The thus obtained average values of the diameter of carbides from four fields of view are further averaged by the number of fields of view, to determine the average equivalent circle diameter of carbide.

The average crystal grain size of ferrite is estimated by photographing a 2500 $\mu m^2$ area at around a quarter thickness position of the sample under a thermal-field-emission type scanning electron microscope (for example, JSM-7001F from JEOL, Ltd.), and by applying the line segment method to the captured image.

The microstructure possessed by the steel sheet for carburizing according to the embodiment has been detailed.

<Thickness of Steel Sheet for Carburizing>

The thickness of the steel sheet for carburizing according to the embodiment is not specifically limited, but is preferably 2 mm or larger, for example. With the thickness of the steel sheet for carburizing specified to be 2 mm or larger, difference of thickness in the coil width direction may further be reduced. The thickness of the steel sheet for carburizing is more preferably 2.3 mm or larger. Further, the thickness of the steel sheet for carburizing is not specifically limited, but is preferably 6 mm or smaller. With the thickness of the steel sheet for carburizing specified to be 6 mm or smaller, load of press forming may be reduced, making forming into components easier. The thickness of the steel sheet for carburizing is more preferably 5.8 mm or smaller.

The steel sheet for carburizing according to the embodiment has been detailed.

(Method for Manufacturing Steel Sheet for Carburizing)

Next, a method for manufacturing the above-explained steel sheet for carburizing according to the embodiment will be detailed.

The manufacturing method for manufacturing the above-explained steel sheet for carburizing according to this embodiment includes (A) the hot-rolling step in which a steel material having the above-explained chemical composition is used to manufacture a hot-rolled steel sheet according to predetermined conditions; (B) the first annealing step in which the obtained hot-rolled steel sheet, or, the steel sheet having been cold-rolled subsequently to the hot-rolling step, is subjected to a first stage annealing according to predetermined heat treatment conditions; (C) the second annealing step in which the steel sheet after undergone the first annealing step is subjected to a second stage annealing according to predetermined heat treatment conditions; and (D) the cooling step in which the steel sheet after annealed in the second annealing step is cooled according to predetermined cooling conditions.

The hot-rolling step, the first annealing step, the second annealing step, and, the cooling step will be detailed below.

<Hot-Rolling Step>

The hot-rolling step described below is a step in which a steel material having the predetermined chemical composition is used to manufacture the hot-rolled steel sheet according to the predetermined conditions.

Steel billet (steel material) subjected now to hot-rolling may be any billet manufactured by any of usual methods. For example, employable is a billet manufactured by any of usual methods, such as continuously cast slab and thin slab caster.

In more detail, using the steel material having the above-explained chemical composition, the steel material is heated and subjected to hot-rolling, then hot finish rolling is terminated in a temperature range of 800° C. or higher and lower than 920° C., followed by cooling over a temperature range from a temperature at the end point of the hot finish rolling down to a cooling stop temperature at an average cooling rate of 50° C./s or higher and 250° C./s or lower, and by winding at a temperature of 700° C. or lower, to thereby manufacture a hot-rolled steel sheet.

[Rolling Temperature of Hot Finish Rolling: 800° C. or Higher, and Lower than 920° C.]

In the hot-rolling step according to this embodiment, rolling in the hot finish rolling need be carried out at a temperature of 800° C. or higher. With the rolling temperature during the hot finish rolling (that is, the finish rolling temperature) dropped below 800° C., also a start temperature of ferrite transformation will be lowered, so that the carbide to be precipitated will be coarsened, and the uniform elongation will degrade. Hence in the hot-rolling step according to this embodiment, the finish rolling temperature is specified to be 800° C. or higher. The finish rolling temperature is preferably 830° C. or higher. Meanwhile, with the finish rolling temperature reached 920° C. or higher, austenitic grains will be distinctively coarsened, so that the sites of production of ferrite will decrease, the ferrite grains will be coarsened, and the local elongation will degrade. Hence in hot-rolling step according to this embodiment, the finish rolling temperature is specified to be lower than 920° C. The finish rolling temperature is preferably lower than 900° C.

[Average Cooling Rate after End of Hot Finish Rolling: 50° C./s or Higher, and 250° C./s or Lower]

In the hot-rolling step according to this embodiment, the steel sheet after the hot finish rolling is cooled at an average cooling rate of 50° C./s or higher and 250° C./s or lower. With the average cooling rate lower than 50° C./s, the austenite grains will excessively grow, making it unable to achieve an effect of micronization of ferrite, resulting in degradation of the local elongation. The average cooling rate after hot finish rolling is preferably 60° C./s or higher, and more preferably 100° C./s or higher. Meanwhile, with the average cooling rate exceeding 250° C./s, the transformation towards ferrite will be suppressed, making it difficult to control the crystal grain size of ferrite to 10 μm or smaller in the steel sheet for carburizing. The average cooling rate after hot finish rolling is preferably 170° C./s or lower.

[Winding Temperature: 700° C. or Lower]

In order to control the microstructure of the steel sheet for carburizing to be manufactured in accordance with the microstructure explained previously, it is preferable that the steel sheet structure (hot-rolled steel sheet) before being subjected to the annealing step in the succeeding stage (in more detail, spherodizing annealing) primarily includes 10% or more and 80% or less in percentage of area of ferrite, and 10% or more and 60% or less in percentage of area of pearlite, totaling 100% or less in percentage of area, and the balance that includes at least any of bainite, martensite, tempered martensite or residual austenite.

If the winding temperature in the hot-rolling step according to the embodiment exceeds 700° C., transformation of ferrite will be excessively promoted to suppress production of pearlite, making it difficult to control, in the steel sheet for carburizing after the annealing step, the percentage of number of carbides with an aspect ratio of 2.0 or smaller, among from the total carbides, to 10% or larger. Hence in the hot-rolling step according to the embodiment, the upper limit of the winding temperature is specified to be 700° C. The lower limit of the winding temperature in the hot-rolling step according to the embodiment is not specifically limited. Since, however, winding at room temperature or below is difficult in practical operation, room temperature will be a substantial lower limit. Note that the winding temperature in the hot-rolling step according to the embodiment is preferably 400° C. or higher, from the viewpoint of further reducing the number density of carbide in the annealing step in the succeeding stage.

Alternatively, the steel sheet thus wound up in the aforementioned hot-rolling step (hot-rolled steel sheet) may be unwound, pickled, and then cold-rolled. Through removal of oxide on the surface of steel sheet by pickling, the hole expandability may further be improved. The pickling may be carried out once, or may be carried out in multiple times. The cold-rolling may be carried out at an ordinary draft (30 to 90%, for example). The hot-rolled steel sheet and cold-rolled steel sheet also include steel sheet temper-rolled under usual conditions, besides the steel sheets that are left unmodified after hot-rolled or cold-rolled.

In the hot-rolling step according to this embodiment, the hot-rolled steel sheet is manufactured as described above. The thus manufactured hot-rolled steel sheet, or, the steel sheet having been cold-rolled subsequently to the hot-rolling step, is further subjected to specific annealing in the two types of annealing step detailed later, and then subjected to specific cooling in the cooling step detailed later. The steel sheet for carburizing according to this embodiment may thus be obtained.

<First Annealing Step>

The first annealing step described below is a step in which the hot-rolled steel sheet obtained by the aforementioned hot-rolling step, or, the steel sheet having been cold-rolled subsequently to the hot-rolling step, is subjected to a first stage annealing (spherodizing annealing) according to specific heat treatment conditions involving a heating temperature of not higher than point $Ac_1$.

In more detail, in the first annealing step according to this embodiment, the above obtained hot-rolled steel sheet, or, the steel sheet having been cold-rolled subsequently to the hot-rolling step, is heated in an annealing atmosphere with the nitrogen concentration controlled to lower than 25% in volume fraction, at an average heating rate of 1° C./h or higher and 100° C./h or lower, up into a temperature range not higher than point $Ac_1$ defined by equation (101) below, and retained in the temperature range not higher than point $Ac_1$ for 1 h or longer and 100 h or shorter.

Now in equation (101) below, notation [X] represents the content of element X (in mass %), which is substituted by zero if such element X is absent.

[Math. 2]

$$Ac_1=750.8-26.6[C]+17.6[Si]-11.6[Mn]-22.9[Cu]-23[Ni]+24.1[Cr]+22.5[Mo]-39.7[V]-5.7[Ti]+232.4[Nb]-169.4[Al]-894.7[B] \quad \text{Equation (101)}$$

[Annealing Atmosphere: Atmosphere with Nitrogen Concentration Controlled to Less than 25% in Volume Fraction]

In the aforementioned first annealing step, the annealing atmosphere is specified so as to have the nitrogen concentration controlled to less than 25% in volume fraction. With the nitrogen concentration set to 25% or higher in volume fraction, coarse carbonitride will be formed in the steel sheet to undesirably degrade the uniform elongation. The lower the nitrogen concentration, the more desirable. Since, however, it is not cost-effective to control the nitrogen concentration below 1% in volume fraction, 1% in volume fraction will be a substantial lower limit.

Atmospheric gas is, for example, at least one gas appropriately selected from gases such as nitrogen and hydrogen, and inert gases such as argon. Such variety of gases may be used so as to adjust the nitrogen concentration in a heating furnace used for the annealing step to a desired value. The atmospheric gas may contain a gas such as oxygen if the content is not so much. The higher the hydrogen concentration in the atmospheric gas, the better. Typically by controlling the hydrogen concentration to 60% or more, heat conduction in an annealing apparatus may be enhanced, and thereby the production cost may be reduced. More specifically, the annealing atmosphere may have a hydrogen concentration of 95% or more in volume fraction, with the balance of nitrogen. The atmospheric gas in the heating furnace may be controlled by, for example, appropriately measuring the gas concentration in the heating furnace, while introducing the aforementioned gas.

[Average Heating Rate: 1° C./h or Higher and 100° C./h or Lower]

In the first annealing step according to this embodiment, the heating need be carried out at an average heating rate of 1° C./h or higher and 100° C./h or lower, up into a temperature range not higher than point $Ac_1$ defined by equation (101) above. With the average heating rate lower than 1° C./h, the carbide will be increasingly coarsened, the average equivalent circle diameter of carbide will exceed 5.0 μm, and the uniform elongation will degrade. The average heating rate in the first annealing step is preferably 5° C./h or higher. Meanwhile, with the average heating rate exceeding 100° C./h, the carbide will not be thoroughly spherodized, making it difficult to control the percentage of the number of carbides with an aspect ratio of 2.0 or smaller, among from the total carbides, to 10% or larger. The average heating rate in the first annealing step is preferably 90° C./h or lower.

[Heating Temperature: Not Higher than Point $Ac_1$]

Meanwhile, as described above, the heating temperature in the first annealing step according to this embodiment need be controlled to not higher than point $Ac_1$ specified by equation (101) above. With the heating temperature exceeding point $Ac_1$, the carbide will not be thoroughly spherodized, making it difficult to control the percentage of the number of carbides with an aspect ratio of 2.0 or smaller, among from the total carbides, to 10% or larger. Note that the lower limit of the temperature range of the heating temperature in the first annealing step is not specifically limited. However, with the temperature range of the heating temperature fallen below 600° C., the retention time in the first annealing will become longer, making the manufacture not cost-effective. Hence, the temperature range of the heating temperature is preferably specified to be 600° C. or higher. For more suitable control of the state of carbide, the temperature range of the heating temperature in the first annealing step according to this embodiment is preferably specified to be 630° C. or higher. Meanwhile, for more suitable control of the state of carbide, the temperature range of the heating temperature in the first annealing step according to this embodiment is preferably specified to be 670° C. or lower.

[Retention Time: In Temperature Range not Higher than Point $Ac_1$, 1 h or Longer and 100 h or Shorter]

In the first annealing step according to this embodiment, the aforementioned temperature range not higher than point $Ac_1$ (preferably 600° C. or higher and point $Ac_1$ or lower) need be kept for 1 h or longer and 100 h or shorter. With the retention time fallen below 1 h, the carbide will not be thoroughly spherodized, making it difficult to control the percentage of the number of carbides with an aspect ratio of 2.0 or smaller, among from the total carbides, to 10% or larger. The retention time of the temperature range not higher than point $Ac_1$ (preferably 600° C. or higher and point $Ac_1$ or lower) in the first annealing step according to this embodiment is preferably 10 h or longer. On the other hand, with the retention time in the temperature range not higher than point $Ac_1$ (preferably 600° C. or higher and not higher than point AO exceeding 100 h, the carbide will be increasingly coarsened, the average equivalent circle diameter of carbide will exceed 5.0 μm, and the uniform elongation will degrade. The retention time in the temperature range not higher than point $Ac_1$ (preferably 600° C. or higher and not higher than point $Ac_1$) in the first annealing step according to this embodiment is preferably 90 h or shorter.

Subsequently to the aforementioned first annealing step, the second annealing step detailed below will be carried out. Now a time interval between the first annealing step and the second annealing step is preferably short as possible. It is more preferable to carry out the first annealing step and the second annealing step in succession, typically by using two heating furnaces juxtaposed to each other.

<Second Annealing Step>

The second annealing step detailed below is a step in which the steel sheet after undergone the aforementioned first annealing step is subjected to second stage annealing (spherodizing annealing) according to specific heat treatment conditions involving a heating temperature of exceeding point $Ac_1$.

In more detail, the second annealing step according to this embodiment is a step in which the steel sheet after undergone the aforementioned first annealing step is heated at an average heating rate of 1° C./h or higher and 100° C./h or lower, up into a temperature range from exceeding point $Ac_1$ defined by equation (101) above to 790° C. or lower, and retained in the temperature range from exceeding point $Ac_1$ to 790° C. or lower for 1 h or longer and 100 h or shorter. Now the conditions regarding the annealing atmosphere in the second annealing step may be same as the conditions regarding the annealing atmosphere in the first annealing step.

[Average Heating Rate: 1° C./h or Higher and 100° C./h or Lower]

In the second annealing step according to this embodiment, heating need be carried out at an average heating rate of 1° C./h or higher and 100° C./h or lower, up into the temperature range from exceeding point $Ac_1$ specified by equation (101) above to 790° C. or lower. With the average heating rate fallen below 1° C./h, the carbide will be increasingly coarsened, the average equivalent circle diameter of carbide will exceed 5.0 μm, and the uniform elongation will degrade. The average heating rate in the second annealing step is preferably 5° C./h or higher. On the other hand, with the average heating rate exceeding 100° C./h, the carbide will not be thoroughly spherodized, making it difficult to control the percentage of the number of carbides with an aspect ratio of 2.0 or smaller, among from the total carbides, to 10% or larger. The average heating rate in the second annealing step is preferably 90° C./h or lower.

[Heating Temperature: From Exceeding Point $Ac_1$ to 790° C. or Lower]

In addition, as mentioned previously, the heating temperature in the second annealing step according to this embodiment need be in the range from exceeding point $Ac_1$ specified by equation (101) above to 790° C. or lower. With the heating temperature fallen to point $Ac_1$ or below, the carbide will not fully melt, making it unable to suppress the number of carbides per 1000 $\mu m^2$ to 100 or less. Note now that the higher the heating temperature in the second annealing step, the more the carbide melts. However with the heating temperature in the second annealing step exceeding 790° C., the carbide having been spherodized in the first annealing step will melt, making it difficult to control the percentage of the number of carbides with an aspect ratio of 2.0 or smaller, among from the total carbides, to 10% or larger. Hence in the second annealing step according to this embodiment, the heating temperature is specified to be 790° C. or lower. The heating temperature in the second annealing step is preferably 780° C. or lower.

[Retention Time: In Temperature Range from Exceeding Point $Ac_1$, to 790° C. or Lower, for 1 h or Longer and 100 h or Shorter]

In the second annealing step according to this embodiment, the aforementioned temperature range from exceeding point $Ac_1$ to 790° C. or lower need be retained for 1 h or longer and 100 h or shorter. With the retention time fallen below 1 h, the carbide will not fully melt, making it unable to suppress the number of carbides per 1000 $\mu m^2$ to 100 or less. The retention time in the temperature range from exceeding point $Ac_1$ to 790° C. or lower is preferably 10 h or longer. On the other hand, with the retention time in the temperature range from exceeding point $Ac_1$ to 790° C. or lower exceeding 100 h, the carbide will be increasingly coarsened, the average equivalent circle diameter of carbide will exceed 5.0 μm, and the uniform elongation will degrade. The retention time in the temperature range from exceeding point $Ac_1$ to 790° C. or lower is preferably 90 h or shorter.

<Cooling Step>

The cooling step detailed below is a step in which the steel sheet, after annealed in the second annealing step, is cooled according to specific cooling conditions.

In more detail, in the cooling step according to this embodiment, the steel sheet after annealed in the second annealing step is subjected to cooling at an average cooling rate of 1° C./h or higher and 100° C./h or lower in a temperature range from a temperature at the end point of annealing in the second annealing step down to 550° C.

[Cooling Conditions: Cooling Down to 550° C. or Below, at Average Cooling Rate of 1° C./h or Higher and 100° C./h or Lower]

In the cooling step according to this embodiment, the steel sheet after retained in the second annealing step is cooled at an average cooling rate of PC/h or higher and 100° C./h or lower, down to 550° C. or below. With the average cooling rate fallen below 1° C./h, the carbide will be increasingly coarsened, the average equivalent circle diameter of carbide will exceed 5.0 μm, and the uniform elongation will degrade. The average cooling rate is preferably 5° C./h or higher. On the other hand, with the average cooling rate exceeding 100° C./h, the carbide will not fully melt, making it unable to suppress the number of carbides per 1000 $\mu m^2$ to 100 or less. The average cooling rate is preferably 90° C./h or lower.

With the cooling stop temperature exceeding 550° C., the carbide will be increasingly coarsened, the average equivalent circle diameter of carbide will exceed 5.0 μm, and the uniform elongation will degrade. Hence the cooling stop temperature in the cooling step according to this embodiment is specified to be 550° C. or below. The cooling stop temperature is preferably 500° C. Note that the lower limit of the cooling stop temperature is not specifically limited.

Since, however, cooling down to room temperature or below is difficult in practical operation, the room temperature will be a substantial lower limit. In addition, the average cooling rate in a temperature range below 550° C. is not specifically limited, allowing cooling at a freely selectable average cooling rate.

The first annealing step, the second annealing step and the cooling step according to this embodiment have been detailed.

By carrying out the above explained hot-rolling step, first annealing step, second annealing step and cooling step, the aforementioned steel sheet for carburizing according to this embodiment may be manufactured.

Note that, subsequently to the aforementioned hot-rolling step and prior to the first annealing step, the hot-rolled steel sheet is preferably subjected to clustering process as an example of the retention step. The clustering process is a treatment for forming a cluster of carbon solid-soluted in the ferrite crystal grain. Such cluster of carbon is a gathering of several carbon atoms formed in the ferrite crystal grain, and acts as a precursor of carbide. The clustering process is carried out typically by retaining the hot-rolled steel sheet in the atmospheric air, in the temperature range of 40° C. or higher and 70° C. or lower, for 72 h or longer and 350 h or shorter. By forming this sort of carbon cluster, formation of carbide in the annealing step in the succeeding stage will further be promoted. As a consequence, the annealed steel sheet will have improved mobility of transition, and will have improved formability.

With the retention temperature fallen below 40° C., or with the retention time fallen below 72 h in the clustering process, carbon will be less likely to diffuse, so that the clustering would not be promoted. Meanwhile with the retention temperature exceeding 70° C., or, with the retention time exceeding 350 h, the clustering will be excessively promoted, so that transition from the state of gathering towards carbide will be more likely to occur, making the carbide oversized in the first annealing step and in the second annealing step, and making the formability more likely to degrade.

Moreover, the thus obtained steel sheet for carburizing may be, for example, subjected to cold working as a post-process. Further, the thus cold-worked steel sheet for carburizing may be subjected to carburization heat treatment, typically within a carbon potential range of 0.4 to 1.0 mass %. Conditions for the carburization heat treatment are not specifically limited, and may be appropriately controlled so as to obtain desired characteristics. For example, the steel sheet for carburizing may be heated up to a temperature that corresponds to the austenitic single phase, carburized, and then cooled naturally down to room temperature; or may be cooled once down to room temperature, reheated, and then quickly quenched. Furthermore, for the purpose of controlling the strength, the entire portion or part of the member may be tempered. Alternatively, the steel sheet may be plated on the surface for the purpose of obtaining a rust-proofing effect, or may be subjected to shot peening on the surface for the purpose of improving fatigue characteristics.

EXAMPLES

Next, examples of the present invention will be explained. Note that conditions described in examples are merely exemplary conditions employed in order to confirm feasibility and effects of the present invention. The present invention is not limited to these exemplary conditions. The present invention can employ various conditions without departing from the spirit of the present invention, insofar as the purpose of the present invention will be achieved.

Test Example 1

Steel materials having chemical compositions listed in Table 1 below were hot-rolled (and cold-rolled) according to conditions listed in Table 2, and then annealed, to obtain the steel sheets for carburizing. In this test example, the aforementioned clustering process was not carried out between the hot-rolling step and the first annealing step. Note that in Table 1 and Table 2 below, the underlines are used to indicate deviation from the scope of the present invention. Also note that "Average cooling rate" under "Cooling step" in Table 2 means average cooling rate over the temperature range from a temperature at the end point of the second annealing down to 550° C.

TABLE 1

| | Chemical Ingredients of Matrix Steel Sheet (in mass %, Balance is Fe and Impurities.) | | | | | | | | | | | | |
|---|---|---|---|---|---|---|---|---|---|---|---|---|---|
| No. | C | Si | Mn | P | S | Sol.Al | N | Ti | Cr | Mo | Ni | Cu | Co |
| 1 | 0.03 | 0.010 | 0.17 | 0.014 | 0.0036 | 0.0130 | 0.0050 | 0.019 | 0.030 | 0.000 | 0.000 | 0.000 | 0.000 |
| 2 | 0.07 | 0.007 | 0.40 | 0.017 | 0.0055 | 0.0150 | 0.0046 | 0.043 | 0.020 | 0.000 | 0.000 | 0.000 | 0.000 |
| 3 | 0.15 | 0.010 | 0.68 | 0.012 | 0.0042 | 0.0110 | 0.0057 | 0.011 | 0.020 | 0.000 | 0.000 | 0.000 | 0.000 |
| 4 | 0.06 | 0.100 | 1.58 | 0.013 | 0.0016 | 0.0570 | 0.0034 | 0.075 | 0.020 | 0.000 | 0.000 | 0.000 | 0.000 |
| 5 | 0.23 | 0.050 | 2.50 | 0.008 | 0.0120 | 0.0320 | 0.0100 | 0.004 | 0.000 | 0.000 | 0.000 | 0.000 | 0.000 |
| 6 | 0.25 | 0.260 | 0.46 | 0.007 | 0.0052 | 0.0290 | 0.0162 | 0.011 | 1.089 | 0.610 | 0.000 | 0.000 | 0.000 |
| 7 | 0.01 | 0.010 | 0.58 | 0.018 | 0.0050 | 0.0160 | 0.0040 | 0.029 | 0.000 | 0.000 | 0.000 | 0.000 | 0.000 |
| 8 | 0.08 | 0.020 | 0.65 | 0.015 | 0.0042 | 0.0130 | 0.0051 | 0.073 | 0.000 | 0.000 | 0.000 | 0.000 | 0.000 |
| 9 | 0.16 | 0.020 | 0.62 | 0.017 | 0.0051 | 0.0130 | 0.0039 | 0.041 | 0.000 | 0.000 | 0.000 | 0.000 | 0.000 |
| 10 | 0.28 | 0.030 | 0.63 | 0.015 | 0.0060 | 0.0140 | 0.0045 | 0.034 | 0.000 | 0.000 | 0.000 | 0.000 | 0.000 |
| 11 | 0.39 | 0.020 | 0.49 | 0.015 | 0.0059 | 0.0130 | 0.0042 | 0.011 | 0.000 | 0.000 | 0.000 | 0.000 | 0.000 |
| 12 | 0.08 | 0.001 | 0.58 | 0.014 | 0.0050 | 0.0140 | 0.0041 | 0.013 | 0.000 | 0.000 | 0.000 | 0.000 | 0.000 |
| 13 | 0.05 | 1.220 | 0.48 | 0.019 | 0.0053 | 0.0160 | 0.0046 | 0.073 | 0.000 | 0.000 | 0.000 | 0.000 | 0.000 |
| 14 | 0.05 | 0.030 | 3.43 | 0.016 | 0.0054 | 0.0120 | 0.0043 | 0.012 | 0.000 | 0.000 | 0.000 | 0.000 | 0.000 |
| 15 | 0.08 | 0.010 | 0.008 | 0.016 | 0.0046 | 0.0130 | 0.0046 | 0.077 | 0.000 | 0.000 | 0.000 | 0.000 | 0.000 |
| 16 | 0.08 | 0.030 | 0.39 | 0.018 | 0.0041 | 0.0110 | 0.0049 | 0.006 | 0.000 | 0.000 | 0.000 | 0.000 | 0.000 |
| 17 | 0.08 | 0.030 | 0.39 | 0.018 | 0.0041 | 0.0110 | 0.0049 | 0.195 | 0.000 | 0.000 | 0.000 | 0.000 | 0.000 |
| 18 | 0.07 | 0.010 | 0.38 | 0.016 | 0.0054 | 0.0190 | 0.0044 | 0.057 | 1.210 | 0.000 | 0.000 | 0.000 | 0.000 |
| 19 | 0.06 | 0.020 | 0.38 | 0.017 | 0.0049 | 0.0130 | 0.0044 | 0.027 | 0.000 | 0.620 | 0.000 | 0.000 | 0.000 |
| 20 | 0.09 | 0.020 | 0.39 | 0.019 | 0.0059 | 0.0170 | 0.0044 | 0.049 | 0.000 | 0.000 | 0.015 | 0.000 | 0.000 |

TABLE 1-continued

| | | | | | | | | | | | | | |
|---|---|---|---|---|---|---|---|---|---|---|---|---|---|
| 21 | 0.08 | 0.010 | 0.55 | 0.016 | 0.0055 | 0.0110 | 0.0046 | 0.025 | 0.000 | 0.000 | 0.000 | 0.030 | 0.000 |
| 22 | 0.08 | 0.030 | 0.37 | 0.017 | 0.0051 | 0.0120 | 0.0048 | 0.015 | 0.000 | 0.000 | 0.000 | 0.000 | 0.610 |
| 23 | 0.07 | 0.020 | 0.45 | 0.018 | 0.0046 | 0.0110 | 0.0047 | 0.026 | 0.000 | 0.000 | 0.000 | 0.000 | 0.000 |
| 24 | 0.08 | 0.010 | 0.36 | 0.015 | 0.0052 | 0.0140 | 0.0041 | 0.015 | 0.000 | 0.000 | 0.000 | 0.000 | 0.000 |
| 25 | 0.06 | 0.030 | 0.37 | 0.018 | 0.0053 | 0.0130 | 0.0048 | 0.036 | 0.000 | 0.000 | 0.000 | 0.000 | 0.000 |
| 26 | 0.07 | 0.020 | 0.57 | 0.014 | 0.0048 | 0.0160 | 0.0043 | 0.059 | 0.000 | 0.000 | 0.000 | 0.000 | 0.000 |
| 27 | 0.08 | 0.020 | 0.46 | 0.016 | 0.0051 | 0.0180 | 0.0050 | 0.020 | 0.000 | 0.000 | 0.000 | 0.000 | 0.000 |
| 28 | 0.08 | 0.020 | 0.44 | 0.017 | 0.0056 | 0.0150 | 0.0039 | 0.020 | 0.000 | 0.000 | 0.000 | 0.000 | 0.000 |
| 29 | 0.07 | 0.030 | 0.49 | 0.015 | 0.0051 | 0.0140 | 0.0051 | 0.076 | 0.000 | 0.000 | 0.000 | 0.000 | 0.000 |
| 30 | 0.05 | 0.460 | 0.43 | 0.014 | 0.0055 | 0.0159 | 0.0046 | 0.040 | 0.000 | 0.000 | 0.000 | 0.000 | 0.000 |
| 31 | 0.07 | 0.009 | 0.02 | 0.014 | 0.0058 | 0.0141 | 0.0047 | 0.039 | 0.000 | 0.000 | 0.000 | 0.000 | 0.000 |
| 32 | 0.06 | 0.006 | 2.88 | 0.015 | 0.0057 | 0.0157 | 0.0048 | 0.044 | 0.000 | 0.000 | 0.000 | 0.000 | 0.000 |
| 33 | 0.09 | 0.005 | 0.41 | 0.084 | 0.0057 | 0.0157 | 0.0049 | 0.048 | 0.000 | 0.000 | 0.000 | 0.000 | 0.000 |
| 34 | 0.06 | 0.009 | 0.44 | 0.017 | 0.0910 | 0.0160 | 0.0049 | 0.042 | 0.000 | 0.000 | 0.000 | 0.000 | 0.000 |
| 35 | 0.09 | 0.005 | 0.40 | 0.014 | 0.0051 | 0.0004 | 0.0042 | 0.043 | 0.000 | 0.000 | 0.000 | 0.000 | 0.000 |
| 36 | 0.09 | 0.005 | 0.43 | 0.014 | 0.0053 | 2.7900 | 0.0051 | 0.048 | 0.000 | 0.000 | 0.000 | 0.000 | 0.000 |
| 37 | 0.06 | 0.006 | 0.39 | 0.021 | 0.0052 | 0.0145 | 0.0003 | 0.041 | 0.000 | 0.000 | 0.000 | 0.000 | 0.000 |
| 38 | 0.08 | 0.008 | 0.42 | 0.019 | 0.0058 | 0.0149 | 0.1800 | 0.044 | 0.000 | 0.000 | 0.000 | 0.000 | 0.000 |
| 39 | 0.08 | 0.008 | 0.42 | 0.018 | 0.0051 | 0.0152 | 0.0047 | 0.140 | 0.000 | 0.000 | 0.000 | 0.000 | 0.000 |
| 40 | 0.06 | 0.009 | 0.43 | 0.020 | 0.0055 | 0.0149 | 0.0043 | 0.040 | 0.007 | 0.000 | 0.000 | 0.000 | 0.000 |
| 41 | 0.07 | 0.009 | 0.44 | 0.020 | 0.0059 | 0.0143 | 0.0051 | 0.047 | 2.770 | 0.000 | 0.000 | 0.000 | 0.000 |
| 42 | 0.07 | 0.005 | 0.38 | 0.021 | 0.0050 | 0.0153 | 0.0041 | 0.042 | 0.000 | 0.007 | 0.000 | 0.000 | 0.000 |
| 43 | 0.08 | 0.009 | 0.37 | 0.015 | 0.0051 | 0.0160 | 0.0041 | 0.038 | 0.000 | 0.960 | 0.000 | 0.000 | 0.000 |
| 44 | 0.09 | 0.009 | 0.36 | 0.016 | 0.0059 | 0.0151 | 0.0048 | 0.047 | 0.000 | 0.000 | 0.030 | 0.000 | 0.000 |
| 45 | 0.08 | 0.008 | 0.43 | 0.013 | 0.0059 | 0.0160 | 0.0049 | 0.038 | 0.000 | 0.000 | 2.930 | 0.000 | 0.000 |
| 46 | 0.06 | 0.007 | 0.41 | 0.017 | 0.0059 | 0.0157 | 0.0041 | 0.045 | 0.000 | 0.000 | 0.000 | 0.003 | 0.000 |
| 47 | 0.06 | 0.005 | 0.40 | 0.013 | 0.0053 | 0.0148 | 0.0043 | 0.040 | 0.000 | 0.000 | 0.000 | 1.950 | 0.000 |
| 48 | 0.08 | 0.006 | 0.40 | 0.018 | 0.0051 | 0.0144 | 0.0045 | 0.039 | 0.000 | 0.000 | 0.000 | 0.000 | 0.004 |
| 49 | 0.05 | 0.005 | 0.41 | 0.020 | 0.0059 | 0.0145 | 0.0042 | 0.043 | 0.000 | 0.000 | 0.000 | 0.000 | 1.880 |
| 50 | 0.06 | 0.006 | 0.36 | 0.020 | 0.0053 | 0.0142 | 0.0046 | 0.047 | 0.000 | 0.000 | 0.000 | 0.000 | 0.000 |
| 51 | 0.09 | 0.005 | 0.40 | 0.020 | 0.0052 | 0.0157 | 0.0043 | 0.044 | 0.000 | 0.000 | 0.000 | 0.000 | 0.000 |
| 52 | 0.05 | 0.005 | 0.41 | 0.017 | 0.0050 | 0.0150 | 0.0048 | 0.047 | 0.000 | 0.000 | 0.000 | 0.000 | 0.000 |
| 53 | 0.08 | 0.008 | 0.39 | 0.018 | 0.0051 | 0.0150 | 0.0049 | 0.038 | 0.000 | 0.000 | 0.000 | 0.000 | 0.000 |
| 54 | 0.07 | 0.009 | 0.38 | 0.016 | 0.0054 | 0.0150 | 0.0045 | 0.042 | 0.000 | 0.000 | 0.000 | 0.000 | 0.000 |
| 55 | 0.06 | 0.009 | 0.37 | 0.019 | 0.0050 | 0.0159 | 0.0041 | 0.046 | 0.000 | 0.000 | 0.000 | 0.000 | 0.000 |
| 56 | 0.07 | 0.009 | 0.38 | 0.015 | 0.0052 | 0.0160 | 0.0046 | 0.039 | 0.000 | 0.000 | 0.000 | 0.000 | 0.000 |
| 57 | 0.07 | 0.008 | 0.38 | 0.016 | 0.0053 | 0.0144 | 0.0043 | 0.040 | 0.000 | 0.000 | 0.000 | 0.000 | 0.000 |
| 58 | 0.05 | 0.005 | 0.43 | 0.018 | 0.0055 | 0.0140 | 0.0045 | 0.039 | 0.000 | 0.000 | 0.000 | 0.000 | 0.000 |

| | Chemical Ingredients of Matrix Steel Sheet (in mass %, Balance is Fe and Impurities.) | | | | | | | $Ac_1$ | |
|---|---|---|---|---|---|---|---|---|---|
| No. | Nb | V | B | Sn | W | Ca | REM | (° C.) | Remark |
| 1 | 0.000 | 0.0000 | 0.0008 | 0.0000 | 0.0000 | 0.0000 | 0.0000 | 746 | |
| 2 | 0.000 | 0.0000 | 0.0001 | 0.0000 | 0.0000 | 0.0000 | 0.0000 | 742 | |
| 3 | 0.000 | 0.0000 | 0.0001 | 0.0000 | 0.0000 | 0.0000 | 0.0000 | 738 | |
| 4 | 0.000 | 0.0000 | 0.0001 | 0.0000 | 0.0000 | 0.0000 | 0.0000 | 723 | |
| 5 | 0.000 | 0.0000 | 0.0000 | 0.0000 | 0.0000 | 0.0000 | 0.0000 | 711 | Comparative steel |
| 6 | 0.000 | 0.0000 | 0.0001 | 0.0000 | 0.0000 | 0.0000 | 0.0000 | 778 | |
| 7 | 0.000 | 0.0000 | 0.0000 | 0.0000 | 0.0000 | 0.0000 | 0.0000 | 741 | Comparative steel |
| 8 | 0.000 | 0.0000 | 0.0000 | 0.0000 | 0.0000 | 0.0000 | 0.0000 | 739 | |
| 9 | 0.000 | 0.0000 | 0.0000 | 0.0000 | 0.0000 | 0.0000 | 0.0000 | 737 | |
| 10 | 0.000 | 0.0000 | 0.0000 | 0.0000 | 0.0000 | 0.0000 | 0.0000 | 734 | |
| 11 | 0.000 | 0.0000 | 0.0000 | 0.0000 | 0.0000 | 0.0000 | 0.0000 | 733 | Comparative steel |
| 12 | 0.000 | 0.0000 | 0.0000 | 0.0000 | 0.0000 | 0.0000 | 0.0000 | 740 | Comparative steel |
| 13 | 0.000 | 0.0000 | 0.0000 | 0.0000 | 0.0000 | 0.0000 | 0.0000 | 762 | Comparative steel |
| 14 | 0.000 | 0.0000 | 0.0000 | 0.0000 | 0.0000 | 0.0000 | 0.0000 | 708 | Comparative steel |
| 15 | 0.000 | 0.0000 | 0.0000 | 0.0000 | 0.0000 | 0.0000 | 0.0000 | 746 | Comparative steel |
| 16 | 0.000 | 0.0000 | 0.0000 | 0.0000 | 0.0000 | 0.0000 | 0.0000 | 743 | Comparative steel |
| 17 | 0.000 | 0.0000 | 0.0000 | 0.0000 | 0.0000 | 0.0000 | 0.0000 | 742 | Comparative steel |
| 18 | 0.000 | 0.0000 | 0.0000 | 0.0000 | 0.0000 | 0.0000 | 0.0000 | 770 | |
| 19 | 0.000 | 0.0000 | 0.0000 | 0.0000 | 0.0000 | 0.0000 | 0.0000 | 757 | |
| 20 | 0.000 | 0.0000 | 0.0000 | 0.0000 | 0.0000 | 0.0000 | 0.0000 | 741 | |
| 21 | 0.000 | 0.0000 | 0.0000 | 0.0000 | 0.0000 | 0.0000 | 0.0000 | 740 | |
| 22 | 0.000 | 0.0000 | 0.0000 | 0.0000 | 0.0000 | 0.0000 | 0.0000 | 743 | |
| 23 | 0.032 | 0.0000 | 0.0000 | 0.0000 | 0.0000 | 0.0000 | 0.0000 | 749 | |
| 24 | 0.000 | 0.0310 | 0.0000 | 0.0000 | 0.0000 | 0.0000 | 0.0000 | 741 | |
| 25 | 0.000 | 0.0000 | 0.0012 | 0.0000 | 0.0000 | 0.0000 | 0.0000 | 742 | |
| 26 | 0.000 | 0.0000 | 0.0000 | 0.1900 | 0.0000 | 0.0000 | 0.0000 | 740 | |
| 27 | 0.000 | 0.0000 | 0.0000 | 0.0000 | 0.0320 | 0.0000 | 0.0000 | 741 | |
| 28 | 0.000 | 0.0000 | 0.0000 | 0.0000 | 0.0000 | 0.0010 | 0.0000 | 741 | |
| 29 | 0.000 | 0.0000 | 0.0000 | 0.0000 | 0.0000 | 0.0000 | 0.0300 | 741 | |
| 30 | 0.000 | 0.0000 | 0.0000 | 0.0000 | 0.0000 | 0.0000 | 0.0000 | 750 | |
| 31 | 0.000 | 0.0000 | 0.0000 | 0.0000 | 0.0000 | 0.0000 | 0.0000 | 746 | |
| 32 | 0.000 | 0.0000 | 0.0000 | 0.0000 | 0.0000 | 0.0000 | 0.0000 | 713 | |
| 33 | 0.000 | 0.0000 | 0.0000 | 0.0000 | 0.0000 | 0.0000 | 0.0000 | 741 | |
| 34 | 0.000 | 0.0000 | 0.0000 | 0.0000 | 0.0000 | 0.0000 | 0.0000 | 741 | |
| 35 | 0.000 | 0.0000 | 0.0000 | 0.0000 | 0.0000 | 0.0000 | 0.0000 | 744 | |
| 36 | 0.000 | 0.0000 | 0.0000 | 0.0000 | 0.0000 | 0.0000 | 0.0000 | 584 | |

TABLE 1-continued

| | | | | | | | | |
|---|---|---|---|---|---|---|---|---|
| 37 | 0.000 | 0.0000 | 0.0000 | 0.0000 | 0.0000 | 0.0000 | 0.0000 | 742 |
| 38 | 0.000 | 0.0000 | 0.0000 | 0.0000 | 0.0000 | 0.0000 | 0.0000 | 741 |
| 39 | 0.000 | 0.0000 | 0.0000 | 0.0000 | 0.0000 | 0.0000 | 0.0000 | 741 |
| 40 | 0.000 | 0.0000 | 0.0000 | 0.0000 | 0.0000 | 0.0000 | 0.0000 | 742 |
| 41 | 0.000 | 0.0000 | 0.0000 | 0.0000 | 0.0000 | 0.0000 | 0.0000 | 781 |
| 42 | 0.000 | 0.0000 | 0.0000 | 0.0000 | 0.0000 | 0.0000 | 0.0000 | 742 |
| 43 | 0.000 | 0.0000 | 0.0000 | 0.0000 | 0.0000 | 0.0000 | 0.0000 | 763 |
| 44 | 0.000 | 0.0000 | 0.0000 | 0.0000 | 0.0000 | 0.0000 | 0.0000 | 741 |
| 45 | 0.000 | 0.0000 | 0.0000 | 0.0000 | 0.0000 | 0.0000 | 0.0000 | 674 |
| 46 | 0.000 | 0.0000 | 0.0000 | 0.0000 | 0.0000 | 0.0000 | 0.0000 | 742 |
| 47 | 0.000 | 0.0000 | 0.0000 | 0.0000 | 0.0000 | 0.0000 | 0.0000 | 697 |
| 48 | 0.000 | 0.0000 | 0.0000 | 0.0000 | 0.0000 | 0.0000 | 0.0000 | 741 |
| 49 | 0.000 | 0.0000 | 0.0000 | 0.0000 | 0.0000 | 0.0000 | 0.0000 | 742 |
| 50 | 0.030 | 0.0000 | 0.0000 | 0.0000 | 0.0000 | 0.0000 | 0.0000 | 749 |
| 51 | 0.130 | 0.0000 | 0.0000 | 0.0000 | 0.0000 | 0.0000 | 0.0000 | 771 |
| 52 | 0.000 | 0.0006 | 0.0000 | 0.0000 | 0.0000 | 0.0000 | 0.0000 | 742 |
| 53 | 0.000 | 0.9400 | 0.0000 | 0.0000 | 0.0000 | 0.0000 | 0.0000 | 704 |
| 54 | 0.000 | 0.0000 | 0.0090 | 0.0000 | 0.0000 | 0.0000 | 0.0000 | 734 |
| 55 | 0.000 | 0.0000 | 0.0000 | 0.8500 | 0.0000 | 0.0000 | 0.0000 | 742 |
| 56 | 0.000 | 0.0000 | 0.0000 | 0.0000 | 0.9300 | 0.0000 | 0.0000 | 742 |
| 57 | 0.000 | 0.0000 | 0.0000 | 0.0000 | 0.0000 | 0.0080 | 0.0000 | 742 |
| 58 | 0.000 | 0.0000 | 0.0000 | 0.0000 | 0.0000 | 0.0000 | 0.2700 | 742 |

TABLE 2

| | | Hot-rolling | | | | | First annealing step | | |
|---|---|---|---|---|---|---|---|---|---|
| No. | Steel No. | Finish rolling temperature (° C.) | Average cooling rate (° C./s) | Winding temperature (° C.) | Cold-rolling Draft in cold-rolling (%) | Nitrogen concentration in annealing atmosphere (%) | Average heating rate (° C./h) | Heating temperature (° C.) | Retention time (h) |
| 1 | 1 | 905 | 81 | 545 | — | 7 | 31 | 655 | 33 |
| 2 | 2 | 842 | 94 | 584 | — | 6 | 15 | 856 | 20 |
| 3 | 3 | 852 | 90 | 555 | — | 6 | 26 | 638 | 48 |
| 4 | 4 | 841 | 86 | 565 | — | 4 | 30 | 646 | 37 |
| 5 | 5 | 872 | 93 | 570 | — | 6 | 11 | 654 | 0 |
| 6 | 6 | 890 | 45 | 510 | — | 5 | 99 | 705 | 36 |
| 7 | 7 | 857 | 71 | 520 | — | 2 | 20 | 658 | 43 |
| 8 | 8 | 846 | 78 | 678 | — | 6 | 44 | 658 | 71 |
| 9 | 9 | 837 | 83 | 641 | — | 7 | 32 | 644 | 84 |
| 10 | 10 | 896 | 74 | 615 | — | 5 | 31 | 641 | 79 |
| 11 | 11 | 848 | 96 | 608 | — | 6 | 21 | 641 | 68 |
| 12 | 12 | 852 | 87 | 596 | — | 5 | 44 | 658 | 63 |
| 13 | 13 | 865 | 79 | 630 | — | 7 | 35 | 676 | 30 |
| 14 | 14 | 905 | 91 | 535 | — | 3 | 38 | 615 | 20 |
| 15 | 15 | 886 | 101 | 628 | — | 6 | 24 | 660 | 47 |
| 16 | 16 | 855 | 82 | 618 | — | 6 | 24 | 652 | 30 |
| 17 | 17 | 855 | 82 | 618 | — | 6 | 24 | 652 | 30 |
| 18 | 18 | 846 | 91 | 575 | — | 4 | 33 | 678 | 80 |
| 19 | 19 | 881 | 90 | 573 | — | 5 | 15 | 667 | 83 |
| 20 | 20 | 847 | 76 | 660 | — | 6 | 26 | 606 | 63 |
| 21 | 21 | 844 | 89 | 658 | — | 4 | 15 | 638 | 21 |
| 22 | 22 | 869 | 86 | 677 | — | 5 | 20 | 648 | 79 |
| 23 | 23 | 886 | 75 | 621 | — | 2 | 28 | 674 | 33 |
| 24 | 24 | 891 | 100 | 593 | — | 5 | 28 | 646 | 29 |
| 25 | 25 | 838 | 84 | 604 | — | 5 | 22 | 656 | 85 |
| 26 | 26 | 847 | 75 | 550 | — | 4 | 24 | 653 | 59 |
| 27 | 27 | 835 | 87 | 566 | — | 4 | 35 | 650 | 56 |
| 28 | 28 | 860 | 78 | 541 | — | 3 | 31 | 653 | 19 |
| 29 | 29 | 898 | 87 | 558 | — | 4 | 43 | 661 | 60 |
| 30 | 30 | 847 | 96 | 572 | — | 8 | 31 | 656 | 57 |
| 31 | 31 | 847 | 94 | 591 | — | 6 | 28 | 660 | 56 |
| 32 | 32 | 840 | 94 | 598 | — | 5 | 30 | 650 | 57 |
| 33 | 33 | 832 | 102 | 567 | — | 10 | 12 | 661 | 54 |
| 34 | 34 | 835 | 90 | 583 | — | 6 | 33 | 667 | 54 |
| 35 | 35 | 833 | 92 | 580 | — | 10 | 42 | 649 | 55 |
| 36 | 36 | 839 | 94 | 585 | — | 6 | 36 | 560 | 60 |
| 37 | 37 | 841 | 97 | 602 | — | 10 | 38 | 658 | 47 |
| 38 | 38 | 843 | 85 | 604 | — | 7 | 18 | 657 | 42 |
| 39 | 39 | 844 | 103 | 583 | — | 5 | 42 | 667 | 46 |
| 40 | 40 | 837 | 90 | 586 | — | 6 | 11 | 661 | 55 |
| 41 | 41 | 832 | 90 | 580 | — | 8 | 25 | 668 | 46 |
| 42 | 42 | 848 | 103 | 565 | — | 4 | 29 | 650 | 46 |
| 43 | 43 | 851 | 94 | 594 | — | 10 | 35 | 662 | 53 |
| 44 | 44 | 851 | 97 | 581 | — | 5 | 28 | 671 | 58 |

TABLE 2-continued

| | | | | | | | | | |
|---|---|---|---|---|---|---|---|---|---|
| 45 | 45 | 851 | 88 | 595 | — | 9 | 39 | 673 | 40 |
| 46 | 46 | 838 | 104 | 600 | — | 6 | 18 | 668 | 56 |
| 47 | 47 | 837 | 102 | 565 | — | 6 | 32 | 669 | 57 |
| 48 | 48 | 850 | 92 | 579 | — | 5 | 30 | 673 | 56 |
| 49 | 49 | 850 | 87 | 577 | — | 4 | 27 | 658 | 58 |
| 50 | 50 | 835 | 85 | 602 | — | 10 | 21 | 663 | 43 |
| 51 | 51 | 845 | 100 | 566 | — | 6 | 18 | 664 | 51 |
| 52 | 52 | 851 | 91 | 567 | — | 9 | 42 | 671 | 42 |
| 53 | 53 | 832 | 92 | 567 | — | 7 | 13 | 659 | 55 |
| 54 | 54 | 851 | 97 | 577 | — | 9 | 38 | 676 | 58 |
| 55 | 55 | 846 | 84 | 578 | — | 4 | 44 | 659 | 58 |
| 56 | 56 | 838 | 96 | 591 | — | 6 | 44 | 674 | 49 |
| 57 | 57 | 852 | 87 | 591 | — | 10 | 22 | 650 | 51 |
| 58 | 58 | 841 | 86 | 566 | — | 5 | 16 | 666 | 40 |
| 59 | 2 | 941 | 82 | 597 | — | 7 | 42 | 671 | 26 |
| 60 | 2 | 881 | 75 | 621 | — | 4 | 34 | 663 | 51 |
| 61 | 2 | 782 | 105 | 574 | — | 6 | 29 | 652 | 45 |
| 62 | 2 | 888 | 281 | 607 | — | 4 | 29 | 652 | 45 |
| 63 | 2 | 871 | 152 | 645 | — | 4 | 29 | 652 | 45 |
| 64 | 2 | 885 | 76 | 655 | — | 3 | 29 | 652 | 45 |
| 65 | 2 | 898 | 42 | 574 | — | 3 | 29 | 652 | 45 |
| 66 | 2 | 904 | 102 | 761 | — | 6 | 23 | 657 | 61 |
| 67 | 2 | 874 | 89 | 542 | — | 2 | 24 | 653 | 22 |
| 68 | 2 | 884 | 98 | 636 | 51 | 6 | 34 | 651 | 50 |
| 69 | 2 | 874 | 80 | 520 | — | 76 | 29 | 654 | 37 |
| 70 | 2 | 882 | 93 | 561 | — | 5 | 40 | 670 | 45 |
| 71 | 2 | 879 | 79 | 616 | — | 6 | 124 | 656 | 75 |
| 72 | 2 | 900 | 101 | 643 | — | 2 | 33 | 654 | 80 |
| 73 | 2 | 862 | 85 | 673 | — | 2 | 0.5 | 665 | 70 |
| 74 | 2 | 864 | 71 | 554 | — | 5 | 19 | 771 | 56 |
| 75 | 2 | 860 | 75 | 570 | — | 6 | 42 | 681 | 74 |
| 76 | 2 | 889 | 76 | 555 | — | 4 | 35 | 670 | 151 |
| 77 | 2 | 870 | 83 | 562 | — | 2 | 24 | 661 | 67 |
| 78 | 2 | 882 | 82 | 686 | — | 4 | 23 | 654 | 0.1 |
| 79 | 2 | 858 | 76 | 685 | — | 2 | 25 | 656 | 75 |
| 80 | 2 | 837 | 86 | 565 | — | 6 | 21 | 654 | 80 |
| 81 | 2 | 852 | 101 | 669 | — | 4 | 2 | 665 | 70 |
| 82 | 2 | 877 | 77 | 546 | — | 7 | 19 | 654 | 56 |
| 83 | 2 | 904 | 86 | 597 | — | 5 | 42 | 652 | 74 |
| 84 | 2 | 904 | 86 | 597 | — | 5 | 42 | 652 | 74 |
| 85 | 2 | 889 | 72 | 674 | — | 6 | 32 | 614 | 68 |
| 86 | 2 | 881 | 91 | 588 | — | 2 | 35 | 670 | 55 |
| 87 | 2 | 904 | 82 | 635 | — | 5 | 24 | 661 | 67 |
| 88 | 2 | 904 | 78 | 535 | — | 3 | 23 | 654 | 51 |
| 89 | 2 | 894 | 102 | 681 | — | 2 | 32 | 652 | 82 |
| 90 | 2 | 881 | 83 | 629 | — | 4 | 20 | 855 | 44 |
| 91 | 2 | 869 | 84 | 642 | — | 6 | 19 | 666 | 37 |
| 92 | 2 | 880 | 83 | 623 | — | 5 | 18 | 655 | 45 |
| 93 | 2 | 858 | 70 | 567 | — | 7 | 46 | 730 | 66 |
| 94 | 2 | 874 | 88 | 558 | — | 2 | 15 | 644 | 89 |
| 95 | 2 | 874 | 81 | 569 | — | 2 | 21 | 658 | 4 |
| 96 | 2 | 905 | 83 | 590 | — | 7 | 41 | 645 | 76 |
| 97 | 2 | 901 | 85 | 607 | — | 7 | 35 | 645 | 69 |
| 98 | 2 | 903 | 82 | 639 | — | 6 | 17 | 659 | 61 |
| 99 | 2 | 905 | 80 | 636 | — | 6 | 30 | 661 | 58 |
| 100 | 2 | 860 | 69 | 579 | — | 7 | 44 | 659 | 69 |

| | Second annealing step | | | | | |
|---|---|---|---|---|---|---|
| No. | Average heating rate (° C./h) | Heating temperature (° C.) | Retention time (h) | Cooling step Average cooling rate (° C./h) | Thickness (mm) | Remark |
| 1 | 31 | 751 | 33 | 34 | 5.3 | Example |
| 2 | 15 | 753 | 20 | 17 | 5.3 | Example |
| 3 | 26 | 749 | 48 | 34 | 5.3 | Example |
| 4 | 30 | 736 | 37 | 36 | 4.3 | Example |
| 5 | 11 | 755 | 4 | 54 | 5.2 | Comparative Example |
| 6 | 5 | 760 | 10 | 10 | 5.2 | Comparative Example |
| 7 | 20 | 768 | 43 | 40 | 5.0 | Comparative Example |
| 8 | 44 | 777 | 71 | 29 | 5.1 | Example |
| 9 | 32 | 750 | 84 | 33 | 5.4 | Example |
| 10 | 31 | 772 | 79 | 21 | 5.0 | Example |
| 11 | 21 | 762 | 68 | 29 | 4.7 | Comparative Example |
| 12 | 44 | 768 | 63 | 28 | 5.5 | Comparative Example |
| 13 | 35 | 760 | 30 | 40 | 4.3 | Comparative Example |
| 14 | 38 | 764 | 20 | 44 | 4.2 | Comparative Example |
| 15 | 24 | 756 | 47 | 26 | 4.8 | Comparative Example |
| 16 | 24 | 762 | 30 | 32 | 4.8 | Comparative Example |

TABLE 2-continued

| | | | | | | |
|---|---|---|---|---|---|---|
| 17 | 24 | 762 | 30 | 32 | 4.8 | Comparative Example |
| 18 | 33 | 776 | 80 | 34 | 3.9 | Example |
| 19 | 15 | 767 | 83 | 40 | 5.3 | Example |
| 20 | 26 | 764 | 63 | 28 | 4.2 | Example |
| 21 | 15 | 776 | 21 | 21 | 5.1 | Example |
| 22 | 20 | 752 | 79 | 23 | 3.9 | Example |
| 23 | 28 | 769 | 33 | 16 | 4.4 | Example |
| 24 | 28 | 779 | 29 | 36 | 5.0 | Example |
| 25 | 22 | 756 | 85 | 31 | 5.5 | Example |
| 26 | 24 | 774 | 59 | 43 | 5.1 | Example |
| 27 | 35 | 773 | 56 | 35 | 5.2 | Example |
| 28 | 31 | 778 | 19 | 39 | 4.3 | Example |
| 29 | 43 | 775 | 60 | 31 | 5.4 | Example |
| 30 | 41 | 763 | 34 | 29 | 5.1 | Example |
| 31 | 44 | 764 | 46 | 34 | 5.5 | Example |
| 32 | 26 | 755 | 24 | 40 | 5.4 | Example |
| 33 | 21 | 750 | 46 | 44 | 5.3 | Example |
| 34 | 12 | 770 | 50 | 43 | 5.4 | Example |
| 35 | 32 | 750 | 45 | 14 | 5.2 | Example |
| 36 | 25 | 733 | 33 | 54 | 5.1 | Example |
| 37 | 38 | 762 | 34 | 53 | 5.5 | Example |
| 38 | 30 | 762 | 45 | 16 | 5.1 | Example |
| 39 | 34 | 751 | 35 | 53 | 5.2 | Example |
| 40 | 39 | 751 | 29 | 40 | 5.4 | Example |
| 41 | 38 | 785 | 27 | 20 | 5.2 | Example |
| 42 | 30 | 752 | 23 | 49 | 5.3 | Example |
| 43 | 32 | 770 | 36 | 40 | 5.3 | Example |
| 44 | 21 | 767 | 17 | 44 | 5.1 | Example |
| 45 | 18 | 758 | 24 | 50 | 5.3 | Example |
| 46 | 14 | 756 | 49 | 24 | 5.2 | Example |
| 47 | 43 | 744 | 27 | 44 | 5.1 | Example |
| 48 | 42 | 749 | 29 | 54 | 5.5 | Example |
| 49 | 19 | 768 | 27 | 16 | 5.4 | Example |
| 50 | 18 | 771 | 33 | 31 | 5.1 | Example |
| 51 | 15 | 785 | 20 | 39 | 5.2 | Example |
| 52 | 36 | 758 | 34 | 43 | 5.3 | Example |
| 53 | 25 | 764 | 33 | 44 | 5.3 | Example |
| 54 | 42 | 746 | 23 | 39 | 5.1 | Example |
| 55 | 35 | 755 | 31 | 29 | 5.1 | Example |
| 56 | 25 | 749 | 48 | 21 | 5.4 | Example |
| 57 | 38 | 750 | 26 | 53 | 5.2 | Example |
| 58 | 31 | 752 | 24 | 42 | 5.5 | Example |
| 59 | 42 | 766 | 26 | 44 | 3.8 | Comparative Example |
| 60 | 34 | 756 | 51 | 15 | 4.4 | Example |
| 61 | 29 | 751 | 45 | 30 | 4.2 | Comparative Example |
| 62 | 29 | 752 | 45 | 30 | 4.2 | Comparative Example |
| 63 | 29 | 762 | 45 | 30 | 4.2 | Example |
| 64 | 29 | 750 | 45 | 30 | 4.2 | Example |
| 65 | 29 | 755 | 45 | 30 | 4.2 | Comparative Example |
| 66 | 23 | 760 | 61 | 42 | 4.7 | Comparative Example |
| 67 | 24 | 754 | 22 | 32 | 5.4 | Example |
| 68 | 34 | 755 | 50 | 25 | 2.8 | Example |
| 69 | 29 | 775 | 37 | 27 | 4.3 | Comparative Example |
| 70 | 40 | 757 | 45 | 22 | 4.4 | Example |
| 71 | 33 | 765 | 75 | 33 | 4.6 | Comparative Example |
| 72 | 21 | 754 | 80 | 20 | 3.9 | Example |
| 73 | 31 | 758 | 70 | 41 | 4.6 | Comparative Example |
| 74 | 19 | 772 | 56 | 34 | 4.5 | Comparative Example |
| 75 | 42 | 767 | 74 | 18 | 4.2 | Example |
| 76 | 35 | 769 | 35 | 31 | 5.5 | Comparative Example |
| 77 | 24 | 753 | 67 | 31 | 5.2 | Example |
| 78 | 23 | 776 | 31 | 27 | 5.4 | Comparative Example |
| 79 | 155 | 771 | 75 | 33 | 4.6 | Comparative Example |
| 80 | 36 | 772 | 80 | 20 | 3.9 | Example |
| 81 | 0.3 | 753 | 70 | 41 | 4.6 | Comparative Example |
| 82 | 19 | 815 | 56 | 34 | 4.5 | Comparative Example |
| 83 | 42 | 764 | 74 | 18 | 4.2 | Example |
| 84 | 6 | 658 | 74 | 18 | 4.2 | Comparative Example |
| 85 | 32 | 758 | 68 | 22 | 4.5 | Example |
| 86 | 35 | 758 | 166 | 31 | 5.5 | Comparative Example |
| 87 | 24 | 756 | 67 | 31 | 5.2 | Example |
| 88 | 23 | 776 | 0.4 | 27 | 5.4 | Comparative Example |
| 89 | 32 | 765 | 82 | 147 | 4.4 | Comparative Example |
| 90 | 20 | 762 | 44 | 34 | 4.6 | Example |
| 91 | 19 | 755 | 37 | 0.8 | 5.2 | Comparative Example |
| 92 | 20 | 755 | 36 | 38 | 4.6 | Example |
| 93 | 50 | 776 | 76 | 28 | 4.3 | Example |
| 94 | 38 | 763 | 58 | 40 | 5.4 | Example |
| 95 | 27 | 756 | 63 | 35 | 5.3 | Example |
| 96 | 41 | 785 | 78 | 17 | 4.4 | Example |

TABLE 2-continued

| | | | | | | |
|---|---|---|---|---|---|---|
| 97 | 61 | 749 | 74 | 25 | 4.2 | Example |
| 98 | 40 | 760 | 92 | 26 | 5.1 | Example |
| 99 | 23 | 746 | 3 | 26 | 5.0 | Example |
| 100 | 45 | 778 | 72 | 94 | 4.2 | Example |

For each of the thus obtained steel sheets for carburizing, measured were (1) the number density of carbide, (2) the percentage of the number of carbides with an aspect ratio of 2.0 or smaller among from the total carbides, (3) the average equivalent circle diameter of carbide, and, (4) the average crystal grain size of ferrite, according to the methods described previously.

Also in order to evaluate uniform elongation and local elongation of each of the thus obtained steel sheets for carburizing, tensile test was carried out. The steel sheet was ground from the top and back surfaces so as to remove equal amounts to be thinned to 2 mm, from which a No. 5 specimen described in JIS Z2201 was prepared, and tensile test was then carried out according to the method described in JIS Z2241 to measure tensile strength, uniform elongation, and local elongation. Note that, for the case where yield point elongation occurred, the uniform elongation was specified by a value given by subtracting the yield point elongation from the uniform elongation.

As a reference, also ideal critical diameter, which is an index for hardenability after carburizing, was calculated. The ideal critical diameter $D_i$ is an index calculated from ingredients of the steel sheet, and may be determined using the equation (201) according to Grossmann/Hollomon, Jaffe's method. The larger the value of ideal critical diameter $D_i$, the more excellent the hardenability.

[Math. 3]

$$D_i=(6.77\times[C]^{0.5})\times(1+0.64\times[Si])\times(1+4.1\times[Mn])\times(1+2.83\times[P])\times(1-0.62\times[S])\times(1+0.27\times[Cu])\times(1+0.52\times[Ni])\times(1+2.33\times[Cr])\times(1+3.14\times[Mo])\times X$$

for [B]=0:X=1 for [B]>0:X=1+1.5×(0.9−[C]) Equation (201)

In this test example, the steel sheets for carburizing showing a tensile strength×uniform elongation (MPa·%) of 6500 or larger, and, a tensile strength×local elongation (MPa·%) of 7000 or larger were accepted as "examples" that excel in ductility.

Microstructures and characteristics of the individual steel sheets for carburizing thus obtained were collectively summarized in Table 3 below.

TABLE 3

| | | Microstructure | | | | Mechanical characteristics | |
|---|---|---|---|---|---|---|---|
| No. | Steel No. | Number of carbides per 1000 μm² of steel sheet (counts) | Percentage of number of carbides with aspect ratio of 2.0 or smaller (%) | Average equivalent circle diameter of carbide (μm) | Average crystal grain size of ferrite (μm) | Tensile strength (MPa) | Uniform elongation (%) |
| 1 | 1 | 32 | 33 | 2.4 | 5.1 | 330 | 21 |
| 2 | 2 | 76 | 40 | 1.8 | 5.1 | 330 | 21 |
| 3 | 3 | 78 | 44 | 1.9 | 6.5 | 365 | 20 |
| 4 | 4 | 83 | 40 | 0.9 | 5.8 | 395 | 19 |
| 5 | 5 | 145 | 73 | 0.6 | 40.0 | 652 | 8 |
| 6 | 6 | 76 | 22 | 0.9 | 19.3 | 390 | 17 |
| 7 | 7 | 21 | 37 | 1.6 | 5.1 | 251 | 30 |
| 8 | 8 | 65 | 36 | 2.0 | 4.5 | 341 | 22 |
| 9 | 9 | 77 | 30 | 0.9 | 4.6 | 379 | 18 |
| 10 | 10 | 91 | 24 | 2.5 | 8.7 | 571 | 12 |
| 11 | 11 | 95 | 29 | 6.9 | 5.0 | 691 | 7 |
| 12 | 12 | 129 | 42 | 1.1 | 6.9 | 332 | 12 |
| 13 | 13 | 61 | 20 | 12.5 | 5.9 | 351 | 11 |
| 14 | 14 | 154 | 23 | 0.8 | 9.1 | 353 | 13 |
| 15 | 15 | 64 | 36 | 16.2 | 6.5 | 356 | 10 |
| 16 | 16 | 62 | 21 | 2.5 | 17.2 | 356 | 21 |
| 17 | 17 | 62 | 21 | 7.8 | 5.9 | 356 | 16 |
| 18 | 18 | 77 | 37 | 2.5 | 9.0 | 369 | 20 |
| 19 | 19 | 74 | 35 | 0.6 | 7.0 | 389 | 20 |
| 20 | 20 | 77 | 42 | 1.7 | 7.9 | 344 | 20 |
| 21 | 21 | 78 | 33 | 0.9 | 8.6 | 332 | 24 |
| 22 | 22 | 66 | 34 | 1.2 | 6.4 | 330 | 22 |
| 23 | 23 | 66 | 43 | 1.9 | 4.5 | 387 | 19 |
| 24 | 24 | 77 | 38 | 1.4 | 5.9 | 353 | 22 |
| 25 | 25 | 75 | 21 | 2.3 | 5.8 | 391 | 20 |
| 26 | 26 | 74 | 33 | 1.7 | 9.5 | 372 | 21 |
| 27 | 27 | 61 | 20 | 0.8 | 6.1 | 393 | 19 |
| 28 | 28 | 80 | 45 | 0.8 | 6.9 | 340 | 22 |
| 29 | 29 | 63 | 33 | 1.4 | 9.3 | 367 | 22 |
| 30 | 30 | 98 | 42 | 1.4 | 5.5 | 394 | 17 |
| 31 | 31 | 80 | 38 | 1.9 | 4.6 | 386 | 23 |
| 32 | 32 | 96 | 45 | 1.4 | 5.5 | 391 | 17 |
| 33 | 33 | 79 | 34 | 1.9 | 5.0 | 409 | 18 |
| 34 | 34 | 72 | 43 | 1.5 | 5.0 | 379 | 20 |

TABLE 3-continued

| | | | | | | | |
|---|---|---|---|---|---|---|---|
| 35 | 35 | 75 | 40 | 2.1 | 5.6 | 359 | 24 |
| 36 | 36 | 72 | 39 | 1.8 | 4.6 | 383 | 17 |
| 37 | 37 | 79 | 30 | 2.1 | 5.6 | 384 | 21 |
| 38 | 38 | 74 | 44 | 1.6 | 4.7 | 394 | 22 |
| 39 | 39 | 80 | 44 | 2.0 | 4.6 | 391 | 19 |
| 40 | 40 | 79 | 37 | 1.9 | 5.0 | 393 | 24 |
| 41 | 41 | 77 | 45 | 1.6 | 5.0 | 414 | 21 |
| 42 | 42 | 77 | 41 | 1.8 | 4.8 | 398 | 20 |
| 43 | 43 | 80 | 42 | 2.0 | 5.0 | 410 | 18 |
| 44 | 44 | 80 | 30 | 1.9 | 4.7 | 369 | 18 |
| 45 | 45 | 77 | 30 | 1.6 | 5.5 | 396 | 22 |
| 46 | 46 | 72 | 34 | 2.0 | 5.5 | 384 | 19 |
| 47 | 47 | 76 | 40 | 1.6 | 5.1 | 389 | 21 |
| 48 | 48 | 79 | 37 | 2.2 | 4.8 | 392 | 24 |
| 49 | 49 | 79 | 33 | 1.5 | 5.2 | 400 | 20 |
| 50 | 50 | 75 | 39 | 1.6 | 5.6 | 399 | 19 |
| 51 | 51 | 73 | 35 | 1.8 | 5.5 | 380 | 20 |
| 52 | 52 | 80 | 45 | 2.0 | 5.4 | 371 | 21 |
| 53 | 53 | 75 | 42 | 2.2 | 5.6 | 384 | 18 |
| 54 | 54 | 76 | 45 | 2.2 | 5.3 | 388 | 25 |
| 55 | 55 | 78 | 41 | 1.5 | 4.7 | 403 | 18 |
| 56 | 56 | 74 | 36 | 2.1 | 4.8 | 387 | 21 |
| 57 | 57 | 72 | 40 | 1.4 | 5.1 | 382 | 22 |
| 58 | 58 | 74 | 33 | 2.2 | 5.3 | 405 | 21 |
| 59 | 2 | 80 | 36 | 1.7 | 14.6 | 338 | 21 |
| 60 | 2 | 61 | 37 | 1.2 | 6.0 | 392 | 18 |
| 61 | 2 | 64 | 35 | 8.6 | 6.9 | 384 | 15 |
| 62 | 2 | 69 | 31 | 1.9 | 12.9 | 396 | 18 |
| 63 | 2 | 67 | 28 | 2.5 | 7.1 | 363 | 20 |
| 64 | 2 | 66 | 30 | 1.2 | 7.6 | 392 | 19 |
| 65 | 2 | 62 | 44 | 1.7 | 11.9 | 402 | 19 |
| 66 | 2 | 71 | 4 | 2.1 | 4.9 | 352 | 17 |
| 67 | 2 | 80 | 29 | 0.7 | 7.7 | 366 | 22 |
| 68 | 2 | 75 | 43 | 2.1 | 8.0 | 370 | 21 |
| 69 | 2 | 72 | 42 | 12.4 | 8.9 | 390 | 15 |
| 70 | 2 | 66 | 41 | 2.2 | 4.7 | 333 | 22 |
| 71 | 2 | 65 | 2 | 1.8 | 7.5 | 357 | 12 |
| 72 | 2 | 61 | 32 | 1.0 | 4.8 | 358 | 21 |
| 73 | 2 | 64 | 30 | 8.2 | 4.8 | 392 | 13 |
| 74 | 2 | 68 | 2 | 0.7 | 5.0 | 371 | 15 |
| 75 | 2 | 65 | 38 | 1.4 | 7.5 | 353 | 22 |
| 76 | 2 | 64 | 44 | 9.2 | 9.1 | 354 | 14 |
| 77 | 2 | 72 | 31 | 1.5 | 8.9 | 386 | 20 |
| 78 | 2 | 72 | 6 | 0.6 | 4.9 | 331 | 18 |
| 79 | 2 | 71 | 8 | 1.3 | 5.2 | 400 | 16 |
| 80 | 2 | 66 | 24 | 0.7 | 7.1 | 387 | 20 |
| 81 | 2 | 65 | 30 | 6.9 | 4.6 | 403 | 16 |
| 82 | 2 | 80 | 6 | 1.2 | 8.4 | 372 | 16 |
| 83 | 2 | 79 | 33 | 1.2 | 4.5 | 355 | 22 |
| 84 | 2 | 166 | 33 | 1.2 | 4.5 | 355 | 17 |
| 85 | 2 | 72 | 38 | 2.5 | 7.2 | 393 | 19 |
| 86 | 2 | 64 | 5 | 2.3 | 9.5 | 335 | 19 |
| 87 | 2 | 62 | 27 | 1.2 | 6.1 | 335 | 22 |
| 88 | 2 | 126 | 41 | 0.7 | 8.1 | 390 | 16 |
| 89 | 2 | 115 | 20 | 2.5 | 8.0 | 333 | 19 |
| 90 | 2 | 67 | 23 | 1.5 | 9.5 | 405 | 18 |
| 91 | 2 | 71 | 20 | 5.6 | 8.3 | 405 | 16 |
| 92 | 2 | 70 | 24 | 1.8 | 9.1 | 395 | 18 |
| 93 | 2 | 79 | 12 | 1.8 | 5.5 | 380 | 18 |
| 94 | 2 | 75 | 40 | 4.8 | 5.0 | 393 | 17 |
| 95 | 2 | 80 | 14 | 1.8 | 4.7 | 391 | 17 |
| 96 | 2 | 79 | 18 | 2.0 | 4.7 | 376 | 18 |
| 97 | 2 | 89 | 37 | 1.6 | 5.5 | 379 | 18 |
| 98 | 2 | 75 | 35 | 4.5 | 5.6 | 400 | 17 |
| 99 | 2 | 95 | 40 | 1.4 | 5.3 | 384 | 17 |
| 100 | 2 | 91 | 31 | 1.8 | 5.5 | 381 | 18 |

| | Mechanical characteristics | | | Harden- | |
|---|---|---|---|---|---|
| No. | Local elongation (%) | Tensile strength × uniform elongation (MPa-%) | Tensile strength × local elongation (MPa-%) | ability Ideal critical diameter (—) | Remark |
| 1 | 22 | 7767 | 8142 | 5.2 | Example |
| 2 | 25 | 7115 | 7680 | 11.7 | Example |
| 3 | 23 | 6711 | 7211 | 22.9 | Example |
| 4 | 21 | 7431 | 7780 | 32.3 | Example |
| 5 | 8 | 4891 | 5019 | 38.3 | Comparative Example |

TABLE 3-continued

| | | | | | |
|---|---|---|---|---|---|
| 6 | 13 | 6736 | 5180 | 235.9 | Comparative Example |
| 7 | 16 | 7507 | 4109 | 2.4 | Comparative Example |
| 8 | 25 | 7537 | 8370 | 7.4 | Example |
| 9 | 19 | 6694 | 7154 | 10.1 | Example |
| 10 | 13 | 6914 | 7491 | 13.6 | Example |
| 11 | 10 | 4519 | 7034 | 13.4 | Comparative Example |
| 12 | 24 | 4125 | 7964 | 6.7 | Comparative Example |
| 13 | 22 | 3965 | 7872 | 8.4 | Comparative Example |
| 14 | 22 | 4682 | 7916 | 24.2 | Comparative Example |
| 15 | 22 | 3478 | 7803 | 2.1 | Comparative Example |
| 16 | 16 | 7592 | 5542 | 5.3 | Comparative Example |
| 17 | 21 | 5873 | 7528 | 5.3 | Comparative Example |
| 18 | 21 | 7432 | 7683 | 18.3 | Example |
| 19 | 22 | 7724 | 8459 | 13.2 | Example |
| 20 | 24 | 7040 | 8201 | 5.7 | Example |
| 21 | 23 | 7817 | 7638 | 6.6 | Example |
| 22 | 24 | 7184 | 7794 | 5.1 | Example |
| 23 | 20 | 7177 | 7642 | 5.4 | Example |
| 24 | 22 | 7790 | 7643 | 5.0 | Example |
| 25 | 22 | 7986 | 8490 | 10.1 | Example |
| 26 | 21 | 7905 | 7952 | 6.3 | Example |
| 27 | 21 | 7404 | 8320 | 5.8 | Example |
| 28 | 23 | 7632 | 7801 | 5.7 | Example |
| 29 | 22 | 7898 | 7948 | 5.7 | Example |
| 30 | 20 | 6698 | 7900 | 4.8 | Example |
| 31 | 19 | 8801 | 7334 | 2.2 | Example |
| 32 | 25 | 6647 | 9795 | 24.4 | Example |
| 33 | 18 | 7280 | 7362 | 7.5 | Example |
| 34 | 19 | 7504 | 7201 | 5.1 | Example |
| 35 | 20 | 8544 | 7180 | 6.1 | Example |
| 36 | 23 | 6511 | 8828 | 6.5 | Example |
| 37 | 27 | 7987 | 10368 | 5.0 | Example |
| 38 | 18 | 8589 | 7092 | 6.1 | Example |
| 39 | 18 | 7351 | 7038 | 7.3 | Example |
| 40 | 19 | 9353 | 7467 | 5.4 | Example |
| 41 | 18 | 8611 | 7452 | 57.2 | Example |
| 42 | 20 | 7880 | 7960 | 5.3 | Example |
| 43 | 19 | 7298 | 7790 | 8.2 | Example |
| 44 | 21 | 6568 | 7749 | 5.9 | Example |
| 45 | 19 | 8633 | 7524 | 10.7 | Example |
| 46 | 22 | 7219 | 8448 | 5.2 | Example |
| 47 | 20 | 8091 | 7780 | 5.0 | Example |
| 48 | 21 | 9330 | 8232 | 5.8 | Example |
| 49 | 19 | 7920 | 7600 | 4.7 | Example |
| 50 | 21 | 7501 | 8379 | 4.8 | Example |
| 51 | 20 | 7524 | 7600 | 6.2 | Example |
| 52 | 22 | 7717 | 8162 | 4.7 | Example |
| 53 | 19 | 6835 | 7296 | 5.7 | Example |
| 54 | 19 | 9700 | 7391 | 11.8 | Example |
| 55 | 18 | 7173 | 7254 | 4.9 | Example |
| 56 | 19 | 8050 | 7353 | 5.2 | Example |
| 57 | 19 | 8328 | 7258 | 5.2 | Example |
| 58 | 19 | 8424 | 7695 | 4.8 | Example |
| 59 | 19 | 7239 | 6436 | 11.7 | Comparative Example |
| 60 | 21 | 7164 | 8193 | 11.7 | Example |
| 61 | 20 | 5897 | 7549 | 11.7 | Comparative Example |
| 62 | 17 | 7245 | 6542 | 11.7 | Comparative Example |
| 63 | 21 | 7246 | 7737 | 11.7 | Example |
| 64 | 21 | 7556 | 8048 | 11.7 | Example |
| 65 | 17 | 7651 | 6694 | 11.7 | Comparative Example |
| 66 | 23 | 6142 | 8000 | 11.7 | Comparative Example |
| 67 | 21 | 7877 | 7764 | 11.7 | Example |
| 68 | 21 | 7612 | 7644 | 11.7 | Example |
| 69 | 21 | 5971 | 8333 | 11.7 | Comparative Example |
| 70 | 25 | 7380 | 8230 | 11.7 | Example |
| 71 | 22 | 4456 | 7862 | 11.7 | Comparative Example |
| 72 | 22 | 7443 | 7733 | 11.7 | Example |
| 73 | 20 | 4986 | 7768 | 11.7 | Comparative Example |
| 74 | 21 | 5638 | 7811 | 11.7 | Comparative Example |
| 75 | 21 | 7917 | 7557 | 11.7 | Example |
| 76 | 24 | 4962 | 8470 | 11.7 | Comparative Example |
| 77 | 20 | 7669 | 7536 | 11.7 | Example |
| 78 | 23 | 5999 | 7646 | 11.7 | Comparative Example |
| 79 | 21 | 6221 | 8214 | 11.7 | Comparative Example |
| 80 | 22 | 7739 | 8432 | 11.7 | Example |
| 81 | 20 | 6321 | 8065 | 11.7 | Comparative Example |
| 82 | 22 | 5988 | 8018 | 11.7 | Comparative Example |
| 83 | 23 | 7731 | 8049 | 11.7 | Example |
| 84 | 23 | 5964 | 8220 | 11.7 | Comparative Example |
| 85 | 20 | 7414 | 7757 | 11.7 | Example |

TABLE 3-continued

| | | | | | |
|---|---|---|---|---|---|
| 86 | 23 | 6222 | 7642 | 11.7 | Comparative Example |
| 87 | 24 | 7386 | 8014 | 11.7 | Example |
| 88 | 21 | 6147 | 8250 | 11.7 | Comparative Example |
| 89 | 24 | 6344 | 8079 | 11.7 | Comparative Example |
| 90 | 19 | 7489 | 7841 | 11.7 | Example |
| 91 | 21 | 6422 | 8414 | 11.7 | Comparative Example |
| 92 | 21 | 7230 | 8324 | 11.7 | Example |
| 93 | 25 | 6840 | 9519 | 11.7 | Example |
| 94 | 25 | 6681 | 9845 | 11.7 | Example |
| 95 | 21 | 6647 | 8231 | 11.7 | Example |
| 96 | 24 | 6768 | 9043 | 11.7 | Example |
| 97 | 22 | 6822 | 8357 | 11.7 | Example |
| 98 | 24 | 6800 | 9620 | 11.7 | Example |
| 99 | 25 | 6528 | 9619 | 11.7 | Example |
| 100 | 24 | 6858 | 9144 | 11.7 | Example |

As is clear from Table 3 above, the steel sheets for carburizing that come under examples of the present invention were found to show a tensile strength×uniform elongation (MPa·%) of 6500 or larger, and, a tensile strength×local elongation (MPa·%) of 7000 or larger, proving excellent ductility. Also the ideal critical diameter, described for reference, was found to be 5 or larger, teaching that the steel sheets for carburizing that come under examples of the present invention also excel in hardenability.

Meanwhile, as is clear from Table 3 above, the steel sheets for carburizing that come under comparative examples of the present invention were found to show at least either of tensile strength×uniform elongation, or, tensile strength× local elongation fallen below the standard values, only proving poor ductility.

Test Example 2

Steel materials having chemical compositions listed in Table 4 below were hot-rolled (and cold-rolled) according to conditions listed in Table 5, and then annealed, to obtain the steel sheets for carburizing. In this test example, each of the steel sheets for carburizing, having undergone, or having not undergone, the aforementioned clustering process between the hot-rolling step and the first annealing step was examined. Note that "Average cooling rate" under "Cooling step" in Table 5 means average cooling rate over the temperature range from a temperature at the end point of the second annealing down to 550° C. Also note that the clustering process was carried out by retaining the hot-rolled steel sheets in the atmospheric air at 55° C. for 105 hours. As is clear from Table 5 below, the individual process steps, except for presence or absence of the clustering process, were carried out almost under the same conditions.

TABLE 4

| | Chemical Ingredients of Matrix Steel Sheet (in mass %, Balance is Fe and Impurities.) | | | | | | | | | | | | |
|---|---|---|---|---|---|---|---|---|---|---|---|---|---|
| No. | C | Si | Mn | P | s | sol.Al | N | Ti | Cr | Mo | Ni | Cu | Co |
| 59 | 0.07 | 0.007 | 0.40 | 0.017 | 0.0055 | 0.0150 | 0.0046 | 0.043 | 0.020 | 0.000 | 0.000 | 0.000 | 0.000 |

| | Chemical Ingredients of Matrix Steel Sheet (in mass %, Balance is Fe and Impurities.) | | | | | | | $Ac_1$ |
|---|---|---|---|---|---|---|---|---|
| No. | Nb | V | B | Sn | W | Ca | REM | (° C.) |
| 59 | 0.000 | 0.0000 | 0.0001 | 0.0000 | 0.0000 | 0.0000 | 0.0000 | 742 |

TABLE 5

| | | Hot-rolling | | | | Cold-rolling | | First annealing step | | |
|---|---|---|---|---|---|---|---|---|---|---|
| . No | Steel No. | Finish rolling temperature (° C.) | Average cooling rate (° C./s) | Winding temperature (° C.) | Presence or absence of clustering process | Draft in cold-rolling (%) | Nitrogen concentration in annealing atmosphere (%) | Average heating rate (° C./h) | Heating temperature (° C.) | Retention time (h) |
| 101 | 59 | 840 | 85 | 571 | X | — | 6 | 12 | 660 | 26 |
| 102 | | 835 | 91 | 588 | ○ | — | 6 | 14 | 654 | 32 |

TABLE 5-continued

| | Second annealing step | | | Cooling step | | |
|---|---|---|---|---|---|---|
| No. | Average heating rate (° C./h) | Heating temperature (° C.) | Retention time (h) | Average cooling rate (° C./h) | Thickness (mm) | Remark |
| 101 | 16 | 749 | 32 | 20 | 5.2 | Example |
| 102 | 19 | 755 | 35 | 22 | 5.2 | Example |

Each of the thus obtained steel sheets for carburizing was subjected to various evaluations in the same way as in the aforementioned test example 1. Moreover in this test example, measurements were made on the carbide in the microstructure, regarding maximum and minimum values of the average equivalent circle diameter of carbide, and difference between the maximum and minimum values, in addition to the items measured in test example 1. Also in order to evaluate cold workability of each of the thus obtained steel sheets for carburizing, in this test example, hole expansion test was carried out in compliance with JIS Z 2256 (Metallic materials—Hole expanding test) in addition to the evaluation items measured in test example 1. A test specimen was sampled from each of the obtained steel sheets for carburizing at a freely selectable position, and hole expansion rate was calculated according to the method and equation specified in JIS Z 2256. In this test example, the cases where the hole expansion rate was found to be 80% or larger were considered to represent good extreme deformability, and accepted as "examples".

Microstructures and characteristics of the individual steel sheets for carburizing thus obtained were collectively summarized in Table 6 below.

TABLE 6

| | | Microstructure | | | | | | |
|---|---|---|---|---|---|---|---|---|
| | | | Percentage | Average equivalent circle diameter of carbide (μm) | | | | |
| No. | Steel No. | Number of carbides per1000 $\mu m^2$ of steel sheet (counts) | of number ofcarbides with aspect ratio of 2.0or smaller(%) | Average equivalent circle diameter | Maximum value | Minimum value | Difference between maximum and minimum values | Average crystal grain size of ferrite (μm) |
| 101 | 59 | 77 | 36 | 2.8 | 1.2 | 4.4 | 3.2 | 4.9 |
| 102 | | 74 | 41 | 2.3 | 2.1 | 2.6 | 0.5 | 4.8 |

| | Mechanical characteristics | | | | | | | |
|---|---|---|---|---|---|---|---|---|
| No. | Tensile strength (MPa) | Uniform elongation (%) | Local elongation (%) | Tensile strength × uniform elongation (MPa-%) | Tensile strength × local elongation (MPa-%) | Hole expandability (%) | Hardenability Ideal critical diameter (—) | Remark |
| 101 | 342 | 22 | 24 | 7524 | 8208 | 116 | 11.7 | Example |
| 102 | 346 | 23 | 25 | 7958 | 8667 | 149 | 11.7 | Example |

As is clear from Table 6 above, size of the obtained carbide was found to be made uniform as a result of the clustering process carried out between the hot-rolling step and the first annealing step, and the steel sheets for carburizing having undergone the clustering process were found to have further improved hole expansion rate.

Although having detailed the preferred embodiments of the present invention, the present invention is not limited to these examples. It is obvious that those having general knowledge in the technical field to which the present invention pertains will easily arrive at various modified examples or revised examples within the scope of technical concept described in claims, and also these examples are naturally understood to come under the technical scope of the present invention.

The invention claimed is:

1. A steel sheet for carburizing consisting of, in mass %,

C: more than or equal to 0.02%, and less than 0.30%,

Si: more than or equal to 0.005%, and less than 0.5%,

Mn: more than or equal to 0.01%, and less than 3.0%,

P: less than or equal to 0.1%,

S: less than or equal to 0.1%, sol. Al: more than or equal to 0.0002%, and less than or equal to 3.0%, N: less than or equal to 0.2%, Ti: more than or equal to 0.010%, and less than or equal to 0.150%, and the balance: Fe and impurities, and optionally in place of part of the balance Fe, one of, or two or more of, in mass %, Cr: more than or equal to 0.005%, and less than or equal to 3.0%

Mo: more than or equal to 0.005%, and less than or equal to 1.0%,

Ni: more than or equal to 0.010%, and less than or equal to 3.0%,

Cu: more than or equal to 0.001%, and less than or equal to 2.0%,

Co: more than or equal to 0.001%, and less than or equal to 2.0%,

Nb: more than or equal to 0.010%, and less than or equal to 0.150%,

V: more than or equal to 0.0005%, and less than or equal to 1.0%,

B: more than or equal to 0.0005%, and less than or equal to 0.01%

Sn: less than or equal to 1.0%,

W: less than or equal to 1.0%,

Ca: less than or equal to 0.01%, and

REM: less than or equal to 0.3% wherein the number of carbides per 1000 $\mu m^2$ is 100 or less when the number density of carbide is measured by photographing a 2500 $\mu m^2$ cross sectional area at around a quarter thickness position of a sample of the steel sheet and observing an area of 20 μm deep in the thickness direction and 50 μm long in the rolling direction, under a thermal-field-emission type scanning electron microscope, and the number of carbides in the observed field of view within the photographed cross sectional area is measured to determine the number of carbides per 1000 $\mu m^2$, percentage of number of carbides with an aspect ratio of 2.0 or smaller is 10% or larger relative to the total carbides when the aspect ratio of carbide is measured by observing a 2500 $\mu m^2$ cross sectional area in the thickness direction at around a quarter thickness position of the sample of the steel sheet, under a thermal-field-emission type scanning electron microscope, all carbides in the observed field of view of the 2500 $\mu m^2$ cross sectional area are measured to determine the aspect ratio of all of the carbides, respectively, and the total number of carbides with the aspect ratio of 2.0 or smaller is calculated, average equivalent circle diameter of carbide is 5.0 μm or smaller, and average crystal grain size of ferrite is 10 μm or smaller.

2. A method for manufacturing the steel sheet for carburizing according to claim 1, the method comprising:

a hot-rolling step, in which a steel material having the chemical composition according to claim 1 is heated, hot finish rolling is terminated in a temperature range of 800° C. or higher and lower than 920° C., followed by cooling over a temperature range from a temperature at an end point of hot finish rolling down to a cooling stop temperature at an average cooling rate of 50° C./s or higher and 250° C./s or lower, and by winding at a temperature of 700° C. or lower; and a first annealing step, in which a steel sheet obtained by the hot-rolling step, or, a steel sheet having been cold-rolled subsequently to the hot-rolling step is heated in an annealing atmosphere with nitrogen concentration controlled to lower than 25% in volume fraction, at an average heating rate of 1° C./h or higher and 100° C./h or lower, up into a temperature range not higher than point $Ac_1$ defined by equation (1) below, and retained in the temperature range not higher than point $Ac_1$ for 1 h or longer and 100 h or shorter;

a second annealing step, in which the steel sheet after undergone the first annealing step is heated at the average heating rate of 1° C./h or higher and 100° C./h or lower, up into a temperature range from exceeding point $Ac_1$ defined by equation (1) below to 790° C. or lower, and retained in the temperature range from exceeding point $Ac_1$ to 790° C. or lower for 1 h or longer and 100 h or shorter; and a cooling step of cooling the steel sheet after annealed in the second annealing step, at an average cooling rate of 1° C./h or higher and 100° C./h or lower in a temperature range from a temperature at an end point of annealing in the second annealing step down to 550° C., where in equation (1) below, notation [X] represents the content of element X (in mass %), which is substituted by zero if such element X is absent,

[Math. 1]

$$Ac_1=750.8-26.6[C]+17.6[Si]-11.6[Mn]-22.9[Cu]-23[Ni]+24.1[Cr]+22.5[Mo]-39.7[V]-5.7[Ti]+232.4[Nb]-169.4[Al]-894.7[B] \quad \text{Equation (1)}$$

3. The method for manufacturing the steel sheet for carburizing according to claim 2, further comprising, between the hot-rolling step and the first annealing step:

retaining the steel sheet obtained from the hot-rolling step, in an atmosphere air, at a temperature from 40° C. or higher and 70° C. or lower, for 72 h or longer and 350 h or shorter.

* * * * *